US009884482B2

(12) United States Patent
Mizutani et al.

(10) Patent No.: US 9,884,482 B2
(45) Date of Patent: Feb. 6, 2018

(54) LIQUID EJECTION HEAD AND LIQUID EJECTION APPARATUS

(71) Applicant: CANON KABUSHIKI KAISHA, Tokyo (JP)

(72) Inventors: Michinari Mizutani, Kawasaki (JP); Kenichi Ueyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/362,679

(22) Filed: Nov. 28, 2016

(65) Prior Publication Data

US 2017/0157928 A1 Jun. 8, 2017

(30) Foreign Application Priority Data

Dec. 2, 2015 (JP) ..... 2015-235900

(51) Int. Cl.
*B41J 2/05* (2006.01)
*B41J 2/14* (2006.01)

(52) U.S. Cl.
CPC ..... *B41J 2/14112* (2013.01); *B41J 2/1404* (2013.01); *B41J 2002/14185* (2013.01); *B41J 2202/11* (2013.01)

(58) Field of Classification Search
CPC ..... B41J 2/1404; B41J 2002/14185; B41J 2202/11; B41J 2/1433; B41J 2002/14387; B41J 2002/14169
USPC ..... 347/20, 54, 56, 61
See application file for complete search history.

(56) References Cited

U.S. PATENT DOCUMENTS 6,471,326 B2 * 10/2002 Tachihara ..... B41J 2/1404 347/19
7,938,511 B2 * 5/2011 Tomizawa ..... B41J 2/1404 347/61
8,449,078 B2 * 5/2013 Nagatsuka ..... B41J 2/1404 347/47
9,138,995 B2 * 9/2015 Mizutani ..... B41J 2/1404

FOREIGN PATENT DOCUMENTS

JP 2012-179902 A 9/2012

* cited by examiner

*Primary Examiner* — An Do
(74) *Attorney, Agent, or Firm* — Canon U.S.A., Inc. IP Division

(57) ABSTRACT

A liquid ejection head in which, upon heating performed by a heating element, a bubble is formed in a liquid retained in a bubble forming chamber, the liquid is ejected, and the bubble disappears without any atmospheric communication. When a length L is a length of the heating element in a liquid supply direction, when viewing in a liquid ejection direction, a position of a center of gravity of an ejection port is spaced apart from a position of a center of gravity of the heating element by L/3.5 or more in the liquid ejection direction, and when a length of an ejecting portion in the liquid ejection direction is l and a length of the bubble forming chamber in the liquid ejection direction is h, l/h is 2 or smaller.

5 Claims, 19 Drawing Sheets

LIQUID EJECTION HEAD AND LIQUID EJECTION APPARATUS

BACKGROUND OF THE INVENTION

Field of the Invention

The present disclosure relates to a liquid ejection head and a liquid ejection apparatus, and, more particularly, relates to a technique that reduces an effect of a cavitation on a heating element in a liquid ejection head that ejects liquid, such as ink.

Description of the Related Art

A method that ejects ink using a heating element is a method in which a bubble is formed in the liquid with the heat generated by the heating element and the liquid is ejected from an ejection port with the pressure of the bubble. In such a method, when the bubble that has been formed on the heating element disappears, a cavitation is formed. The cavitation may have an adverse effect, such as shortening the life of the heating element.

Conversely, Japanese Patent Laid-Open No. 2012-179902 discloses a liquid ejection head in which a center of an ejection port is offset with respect to a center of a heating element in a direction in which the ink is supplied to the heating element. Such a liquid ejection head is capable of performing atmospheric communication without dividing the bubble while the bubble is disappearing. With the above, formation of a cavitation on the heating element with the divided bubble can be suppressed, and the adverse effect on the life of the heating elements can be reduced.

However, the ejection configuration of the print head disclosed in Japanese Patent Laid-Open No. 2012-179902 is for a type of print head in which atmospheric communication is performed while the bubble is disappearing. Accordingly, in a type of print heads that do not perform atmospheric communication, the mechanism of suppressing the cavitation is different and the technique disclosed in Japanese Patent Laid-Open No. 2012-179902 cannot be used as it is.

SUMMARY OF THE INVENTION

The present disclosure provides a liquid ejection head and a liquid ejection apparatus capable of suppressing adverse effects to occur on the heating element due to the cavitation, in a type of liquid ejection head that does not perform atmospheric communication.

The present disclosure provides a liquid ejection head including a bubble forming chamber capable of retaining a liquid therein, a heating element disposed in a surface oriented towards the bubble forming chamber, the heating element capable of heating the liquid retained inside the bubble forming chamber, an ejection port that ejects the liquid that the bubble forming chamber has retained and that has been heated, an ejecting portion that communicates the liquid between the ejection port and the bubble forming chamber, a liquid supply port that supplies the liquid to the bubble forming chamber, and a flow path resistor that serves as a resistance of a flow of the liquid in the bubble forming chamber. Upon heating performed by the heating element, a bubble is formed in the liquid retained in the bubble forming chamber, the liquid is ejected, and the bubble disappears without any atmospheric communication. When a length L is a length of the heating element in a direction in which the liquid is supplied, when viewing in a direction in which the liquid is ejected, a position of a center of gravity of the ejection port is spaced apart from a position of a center of gravity of the heating element by L/3.5 or more in the direction in which the liquid is ejected. When a length of the ejecting portion in the direction in which the liquid is ejected is l and a length of the bubble forming chamber in the direction in which the liquid is ejected is h, l/h is 2 or smaller.

Further features of the present invention will become apparent from the following description of exemplary embodiments with reference to the attached drawings.

DESCRIPTION OF THE EMBODIMENTS

Hereinafter, exemplary embodiments of a liquid ejection head and a liquid ejection apparatus according to the present disclosure will be described in detail with reference to the drawings.

First Exemplary Embodiment

Figure 1:
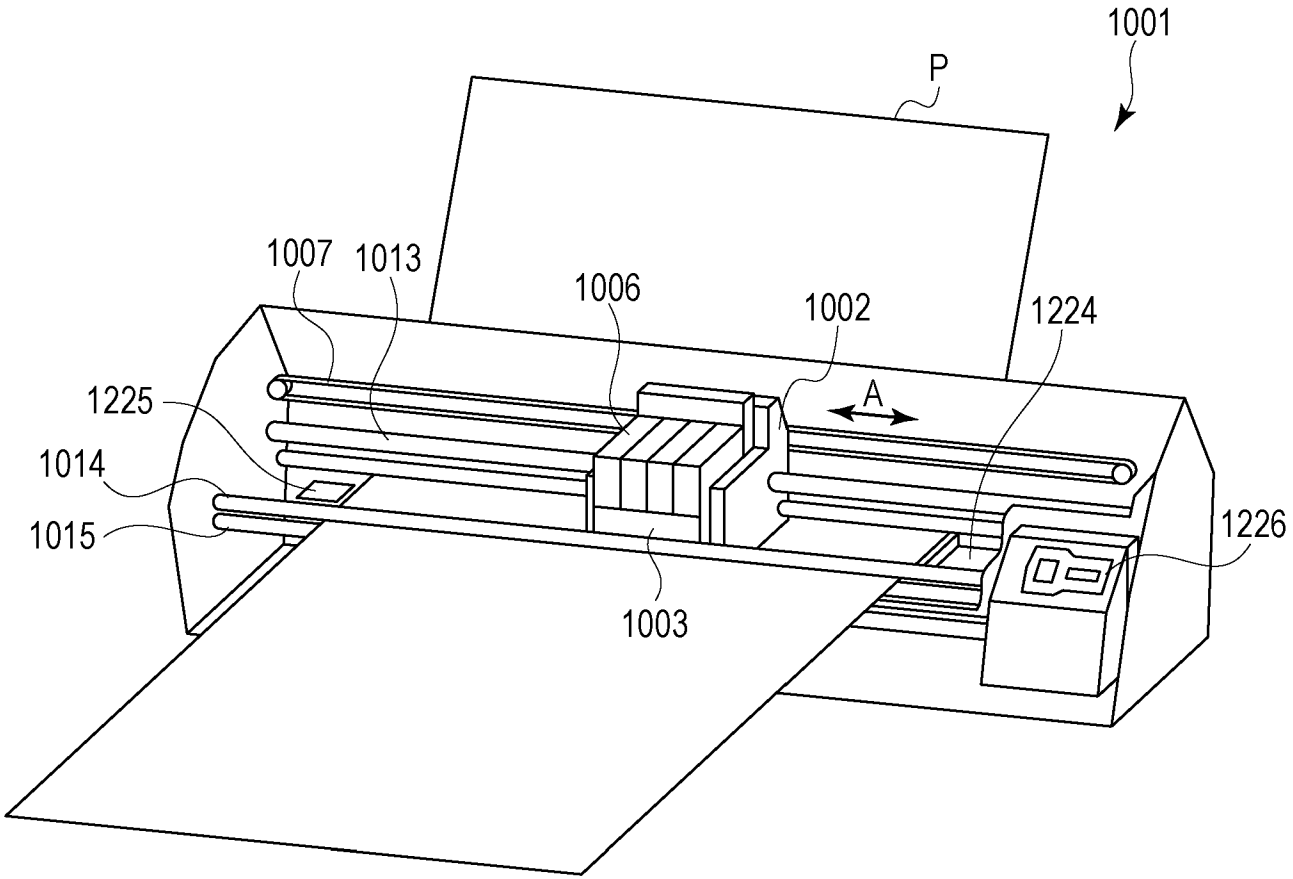
FIG. 1 is a perspective view of an ink jet printing apparatus according to an exemplary embodiment of a liquid ejection apparatus of the present disclosure.

FIG. 1 is a perspective view of an ink jet printing apparatus according to an exemplary embodiment of the liquid ejection apparatus of the present disclosure. A print head 1003 serving as a liquid ejection head and ink cartridges 1006 in which ink supplied to the print head 1003 is stored are detachably mounted in a carriage 1002 of an ink jet printing apparatus 1001. Note that rather than being separate components, the print head 1003 and the ink cartridges 1006 may be a single component. The ink cartridges 1006 are provided for various colors of ink, namely, magenta (M), cyan (C), yellow (Y), black (K), and four ink cartridges 1006 are mounted in the carriage 1002.

In a case in which the print head 1003 is mounted in the carriage 1002, each of the ink cartridge 1006 is electrically connected to an apparatus main body side through a corresponding electric connecting portion. With the above, the print head 1003 is capable of performing an operation, such as ejecting ink, according to a print signal from the body side. As described later with reference to FIG. 2 and the following drawings, the print head 1003 includes heating elements corresponding to a plurality of ejection ports. Ink serving as a liquid is ejected from each ejection port by generating a bubble inside the ink with the heat generated by the corresponding heating element according to a print signal.

A guide shaft 1013 is disposed in the ink jet printing apparatus 1001 so as to extend in a main scanning direction of the carriage 1002. The carriage 1002 is supported in a slidable manner with the guide shaft 1013. With the above, the moving carriage 1002 is guided along the guide shaft 1013 in an arrow A direction. Furthermore, driving force of a carriage motor is transmitted to the carriage 1002 through a drive belt 1007 serving as a transfer mechanism such that the carriage 1002 is capable of moving reciprocally. With the above configuration, by ejecting ink while scanning the print head 1003 in the main scanning direction, recording on an entire width of a record medium P on a platen can be performed. Furthermore, the record medium P can be conveyed in a conveyance direction with a conveyance roller 1014 that is driven by a conveyance motor (not shown) and a pinch roller 1015 that abuts the record medium P against the conveyance roller 1014.

Furthermore, a cap 1226 that caps the ejection ports and that is capable of accepting the ink ejected from the print head 1003 is disposed at an end portion of a moving area of the print head 1003. In a state in which the cap 1226 caps the ejection ports of the print head 1003, preliminary ejection is performed with pigment ink and ink is suctioned into the cap; accordingly, ink that has been ejected by preliminary ejection can be collected. Furthermore, a platen preliminary ejection position home portion 1224 and a platen preliminary ejection position away portion 1225 that is capable of accepting the ink ejected when preliminary ejection is performed on the platen are disposed outside of the conveyance path of the record medium P.

Figure 2:
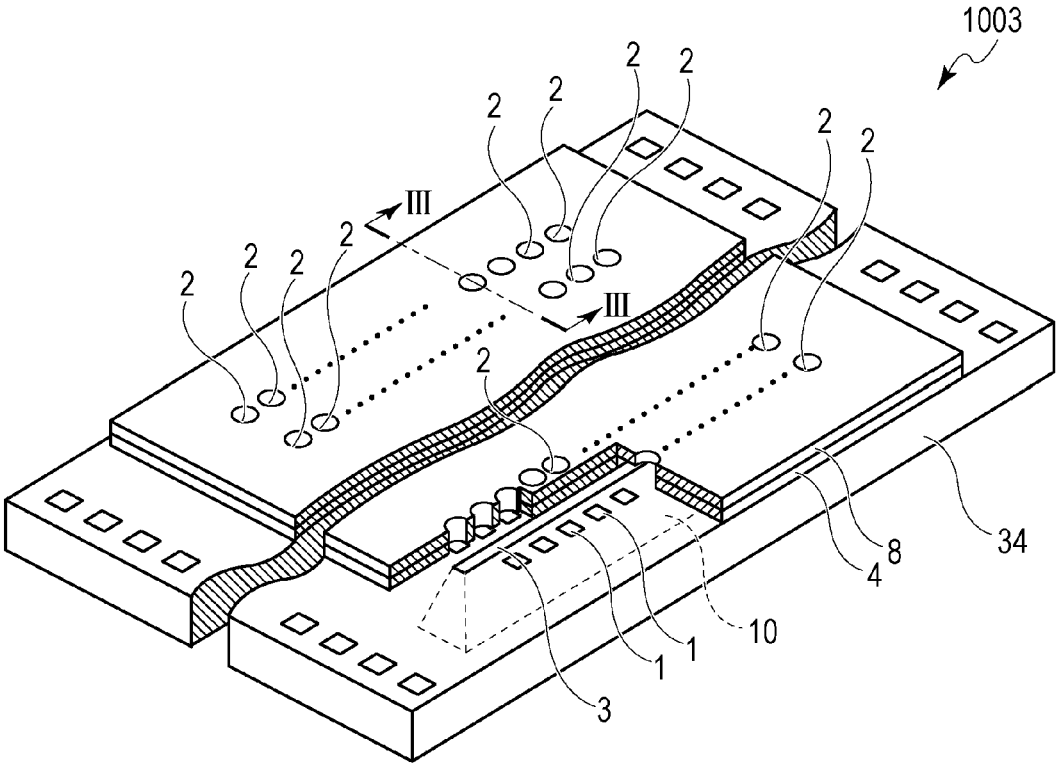
FIG. 2 is a perspective view illustrating a print head of the exemplary embodiment illustrated in FIG. 1 in a partially broken away manner.
Figure 3:
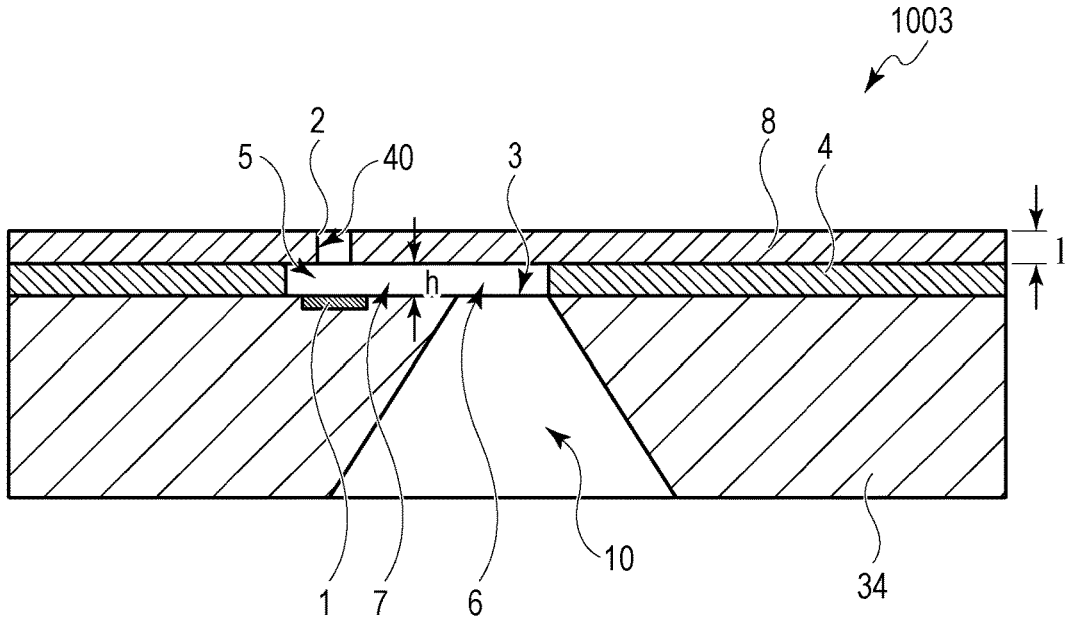
FIG. 3 is a cross-sectional view of the print head in FIG. 2 taken along line III-III.

FIG. 2 is a perspective view illustrating the print head of the present exemplary embodiment illustrated in FIG. 1 in a partially broken away manner. Furthermore, FIG. 3 is a cross-sectional view of the print head in FIG. 2 taken along line III-III.

Referring to the above drawings, the print head 1003 includes a substrate 34, a flow path constituting portion 4, and a nozzle plate 8. The flow path constituting portion 4 and the nozzle plate 8 are provided on the substrate 34. Ink supply chambers 10 and ink supply ports (liquid supply ports) 3 are formed in the substrate 34, and each ink supply chamber 10 is in communication with a common liquid chamber 6 and a liquid flow path 7 through a corresponding ink supply port 3 that is an opening provided in the substrate surface. Bubble forming chambers 5 are each defined between the flow path constituting portion 4 and the nozzle plate 8 that are attached to the substrate 34. Ejection ports 2 serving as openings to eject ink retained in the bubble forming chambers 5 to the outside are formed in the nozzle plate 8. Ejecting portions 40 serving as flow paths that supply ink retained in the bubble forming chambers 5 to the ejection portions 2 are formed in the nozzle plate 8. The ink is communicated between the ejection ports 2 and the bubble forming chambers 5 with the ejecting portions 40.

As illustrated in FIG. 2, long and narrow rectangular ink supply ports 3 are formed in the surface of the substrate 34 on which the flow path constituting portion 4 and the nozzle plate 8 are attached. The ink supply ports 3 are long groove-shaped openings formed in the surface of the substrate 34 and correspond to openings to the ink supply chambers 10. The ink supply chambers 10 are provided in the substrate 34 as grooves and are in communication with the bubble forming chambers 5 and the ejection ports 2 through the ink supply ports 3 and the liquid flow path 7.

Heating elements 1 serving as ejection energy generating elements that act on the ejection of the ink are disposed in a surface of the substrate 34 at positions facing the bubble forming chambers 5. A line of heating elements 1 is arranged at intervals, or pitches, of 600 dpi along each of the two sides of the ink supply ports 3 in the longitudinal direction. The ejection ports 2 are provided in the nozzle plate 8 so as to correspond to the heating elements 1. The substrate 34 functions as a portion of the flow path constituting portion 4 and the material thereof is not limited to any material and may be any material that is capable of functioning as a supporting member of the ejection energy generating elements, the ejection ports 2, and a material layer described later that forms the flow path. In the present exemplary embodiment, a silicon substrate is used for the substrate 34. As illustrated in FIG. 3, the liquid flow path 7 that guides the ink from each ink supply port 3 to the corresponding bubble forming chambers 5 is formed between each ink supply port 3 and the corresponding bubble forming chamber 5. Note that in the present exemplary embodiment, while the nozzle plate 8 and the flow path constituting portion 4 are same members, a similar effect can be obtained even when the nozzle plate 8 and the flow path constituting portion 4 are different members.

Furthermore, referring to FIG. 3, in the present exemplary embodiment, the height h of the flow path constituting portion 4 is 20 μm, and the thickness l of the nozzle plate 8 is 23 μm. The ejection amount of the ink droplet ejected through the ejection ports 2 from the heating elements 1 is 13 ng. Note that in the present exemplary embodiment, the print head 1003 is heated by a temperature adjustment unit (not shown) and the viscosity of the ink is about 1.7.

Figure 4:
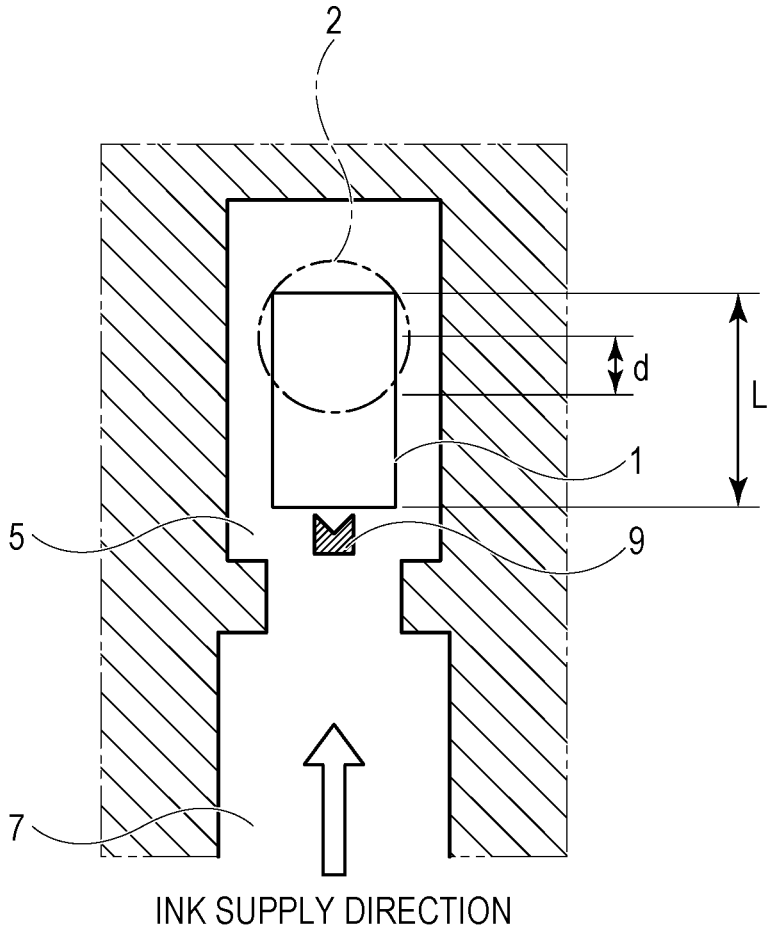
FIG. 4 is a cross-sectional view illustrating a positional relationship between an ejection port and a heating element in a flow path structure of the print head according to a first exemplary embodiment of the present disclosure.

FIG. 4 is a cross-sectional view illustrating a positional relationship between the ejection port 2 and the heating element 1 in the flow path structure of the print head 1003 according to the first exemplary embodiment of the present disclosure. As illustrated in FIG. 4, the ejection port 2 is round and is a circle with a radius of 10 μm. In the present exemplary embodiment, the offset amount of the center of the ejection port 2 with respect to the center of the heating element 1 is 15 μm in a supply direction (the direction indicated by an arrow in the figure) in which the ink is supplied from the ink supply port 3 to the bubble forming chamber 5. Furthermore, a length of the heating element 1 in a direction orthogonal to the supply direction is 23.2 μm and a length L thereof in the supply direction is 38.8 μm. The heating element 1 has a rectangular shape in which the aspect ratio is 1.67 (=38.8/23.4). Note that in the present exemplary embodiment, since the ejection port 2 is circular, the center of the ejection port 2 is the center position of the circle. Furthermore, since the heating element 1 has a rectangular shape long in the supply direction, the center of the heating element 1 is defined as the intersection point of the diagonal lines of the rectangular heating element 1.

Furthermore, the flow path structure of the present exemplary embodiment includes a flow path resister 9 near the heating element 1. A recessed portion is formed in the flow path resistor 9 on a surface on a back side with respect to a surface on a liquid supply port 3 side. Furthermore, a length of the flow path resistor 9 in the direction orthogonal to the ink supply direction is 6 μm, a length in the ink supply direction is 6 μm, and a distance from an end of the heating element 1 closest to the flow path resistor 9 to the center of the flow path resistor 9 is 5.85 μm. Accordingly, the distance between the closest end of the heating element 1 to the liquid contact surface of the flow path resistor 9 on the side close to the heating element 1 is 2.85 μm. Note that a similar effect to that of the present exemplary embodiment can be obtained when the distance is 2.85 μm or smaller. Furthermore, the height (the height in the direction perpendicular to the drawing of FIG. 4) of the flow path resistor 9 is the same as the height of the flow path 7. In other words, the flow path resistor 9 is provided so as to extend from a bottom wall surface to an upper wall surface of the flow path 7.

By disposing each ejection port 2 and the corresponding flow path resistor 9 in the above manner, cavitation in the upper surface of the heating elements 1 and the effect of the cavitation on the heating elements 1 can be suppressed. Such a mechanism will be described below.

FIGS. 5A to 5D are schematic cross-sectional views for chronologically describing the process in which the bubble disappears when ejecting ink with the print head 1003 according to the present exemplary embodiment and are diagrams of the heating element 1 viewed from above. Furthermore, FIGS. 6A to 6D are cross-sectional views corresponding to FIGS. 5A to 5D, respectively, viewing the bubble disappearing process from the lateral side of the flow path structure, and are cross-sectional views taken along lines VIA-VIA, VIB-VIB, VIC-VIC, VID-VID of FIGS. 5A to 5D, respectively.

A bubble 120 is first formed on the heating element 1 by supplying a voltage pulse to the heating element 1 and generating heat. In other words, by generating heat in the heating element 1, the ink inside the bubble forming chamber 5 is heated causing film boiling to occur in the ink such that a bubble 120 is formed. The bubble 120 generated by heating develops and with the bubbling pressure at this point, a portion of the ink retained in the bubble forming chamber 5 is ejected from the ejection port 2.

Figure 5A:
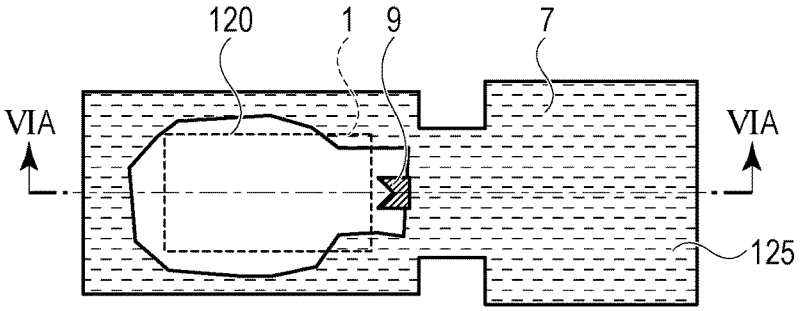
FIGS. 5A to 5D are schematic cross-sectional views for chronologically describing the process in which the bubble disappears when ejecting ink with the print head according to the first exemplary embodiment.
Figure 6A:
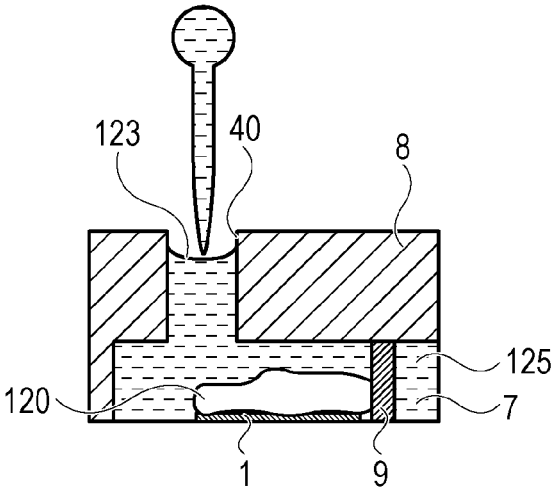
FIGS. 6A to 6D are cross-sectional views corresponding to FIGS. 5A to 5D, respectively, viewing the bubble disappearing process from the lateral side of the flow path structure.

After increase in the volume of the bubble 120 reaching its maximum volume in the above manner, as illustrated in FIGS. 5A and 6A, upon start of contraction of the bubble 120, a meniscus 123 of the ink positioned inside the ejecting portion 40 in communication with the ejection port 2 moves down towards and into the bubble forming chamber 5. At this point, since the flow path resistor 9 is disposed at a position that is relatively close to the heating element 1, the recessed portion of the flow path resistor 9 is filled with the bubble 120 that has developed through bubbling. Note that when the ink droplet is ejected, the amount of ink corresponding to the amount ejected upon the contraction of the bubble 120 is refilled into the bubble forming chamber 5.

Figure 5B:
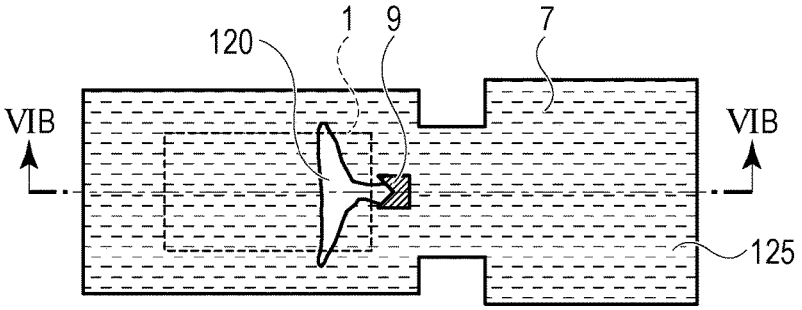
Figure 5C:
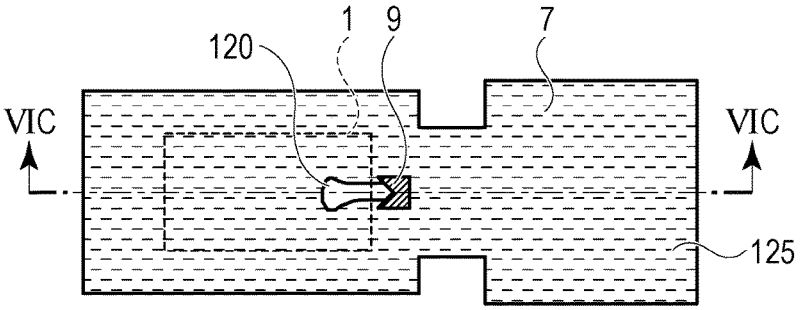
Figure 5D:
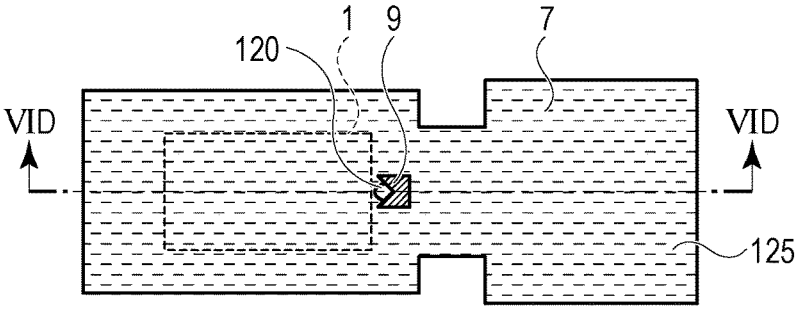
Figure 6B:
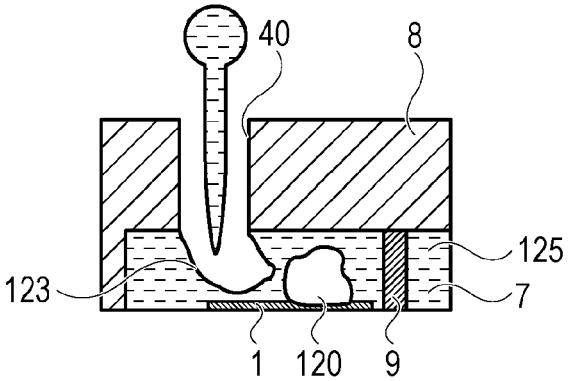
Figure 6C:
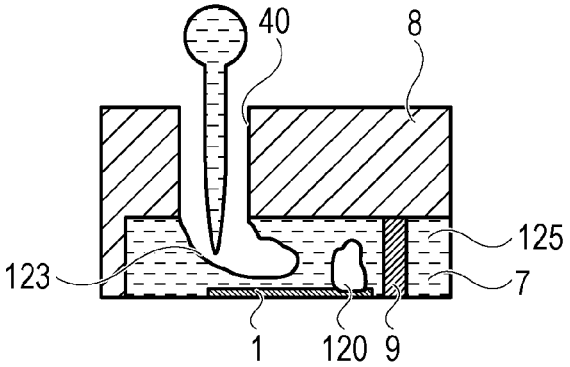
Figure 6D:
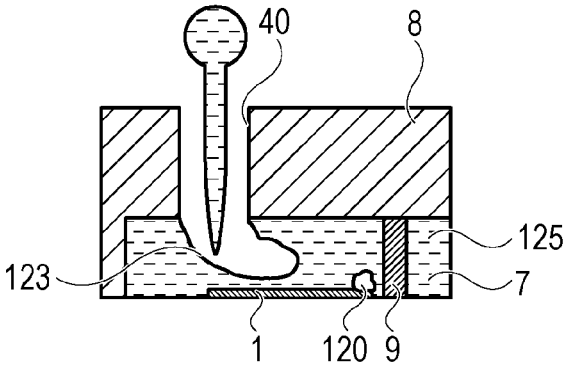

FIGS. 5B to 5D and 6B to 6D chronologically illustrate the bubble 120 disappearing while the meniscus 123 moves down. As illustrated in FIG. 4, in the present exemplary embodiment, the position of the ejection port 2 is set such that the center of the ejection port 2 is displaced largely in the ink supply direction with respect to the center of the heating element 1. As a result, as illustrated in FIGS. 6B to 6D, the meniscus 123 moves down from the far side area of the heating element 1 that is an area closer to the wall surface of the bubble forming chamber 5. The meniscus 123 that moves down from the ejecting portion 40 is deviated towards a direction that is opposite to the ink supply direction of the bubble forming chamber 5 and is unevenly deformed towards the ink supply port 3.

FIG. 6B illustrates a state in which the meniscus 123 has moved down into the bubble forming chamber 5 through the ejecting portion 40. Furthermore, FIG. 5B illustrates a state of the portion extending along the plane immediately above the heating element 1 in the above state. As illustrated in FIG. 5B, as the meniscus 123 moves down, the far side area of the bubble 120 close to the wall surface of the bubble forming chamber 5 is contracted while being squashed. Meanwhile, at this point, in the area of the bubble forming chamber 5 closed to the ink supply port 3, ink 125 is refilled into the bubble forming chamber 5 from the ink supply port 3 through the liquid flow path 7. However, in the flow path structure of the present exemplary embodiment, since the bubble 120 is adhered to the recessed portion of the flow path resistor 9, the refilling of the ink 125 at the middle portion of the flow path 7 where the flow path resistor 9 is positioned is delayed with respect to the other portions. As a result, the shape of the bubble 120 turns into the shape illustrated in FIG. 5B.

FIGS. 6C and 6D illustrate a state of the bubble 120 and the meniscus 123 immediately before the bubble 120 disappear and, furthermore, FIGS. 5C and 5D illustrate a state of the portion extending along the plane immediately above the heating element 1 in the above state. As described above, in the flow path structure of the present exemplary embodiment, since each ejection port 2 is disposed so that the center of the ejection port 2 is displaced relatively largely in the ink supply direction with respect to the center of the corresponding heating element 1, while the bubble 120 disappears, the bubble 120 is not easily divided due to the presence of the meniscus 123. Owing to the above, division of the bubble in the far side area closed to the wall surface of the bubble forming chamber 5 does not occur. Furthermore, as illustrated in FIGS. 5C and 5D, the bubble ultimately disappears at a portion of the recessed portion of the flow path resistor 9 that is outside the heating element 1 without having any atmospheric communication.

Figure 7A:
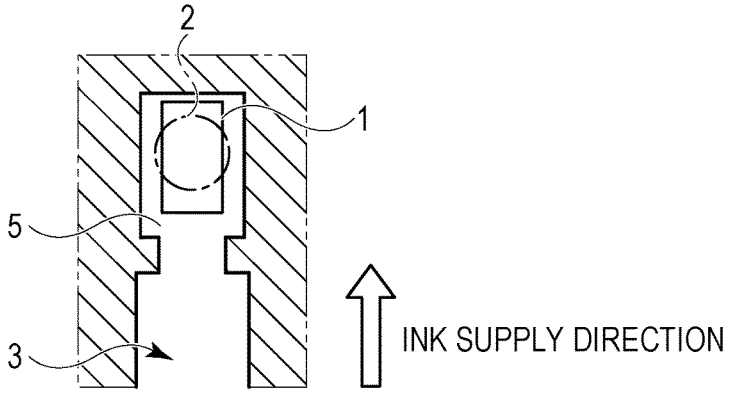
FIGS. 7A to 7D are schematic cross-sectional views illustrating the structure of the flow paths of the print heads of the plurality of comparative examples.
Figure 7B:
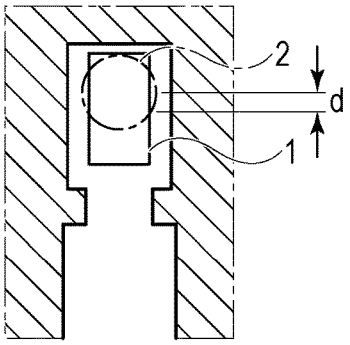
Figure 7C:
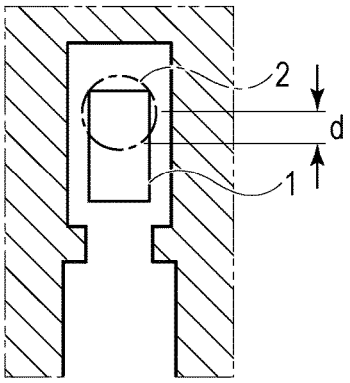
Figure 7D:
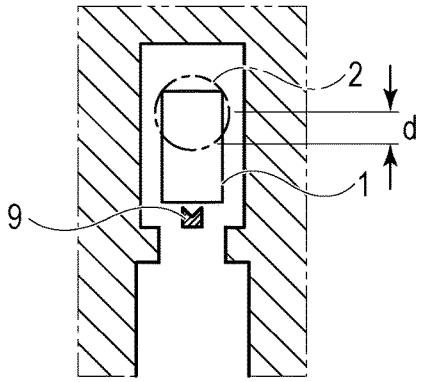

As described above, due to the effect of the flow path resistor 9, the position where the bubble 120 disappear is outside the heating element 1; accordingly, the impact on the heating element 1 acting on a single location in a concentrated manner can be averted. As a result, the effect on the heating element 1 caused by cavitation can be reduced.

in FIGS. 7B, 7C, and 7D, the center of the ejection port 2 was displaced in the ink supply direction with respect to the center of the heating element 1. In the examples illustrated in FIGS. 7A to 7D, the degree in which the cavitation is formed in the flow path 7 during the ejection of ink, and whether there was any damage to the heating element during the ejection durability test were confirmed. The result of the experiment will be described in table 1. In "Degree in which Cavitation is Formed" of table 1, "○" indicates that no cavitation had been formed on the heating element, "Δ" indicates a minor cavitation had been formed, and "x" indicates that there were some damages in the heating element due to formation of the cavitation. Note that the result associated with the present exemplary embodiment is also illustrated in table 1.

TABLE 1

| | Comparative Example 1 | Comparative Example 2 | Comparative Example 3 | Comparative Example 4 | First Exemplary Embodiment |
|---|---|---|---|---|---|
| Positional Displacement Amount d (μm) | 0 | 6 | 15 | 15 | 15 |
| Flow Path Resistor | none | none | none | present | present |
| l/h | ≤2 | ← | ← | >2 | ≤2 |
| Degree in which Cavitation was Formed | x | x | Δ | x | ○ |

The following three parameters P1 to P3 can be derived from the above in order to move the bubble disappearing position to a position outside of the heating element 1 after the bubble 120 is formed inside the bubble forming chamber 5. P1: positional displacement amount d between the center of the heating element 1 and the center of the ejection port 2 (see FIG. 4), P2: whether there is a flow path resistor 9 present, P3: ratio between the height h of the flow path constituting portion 4 and the thickness l of the nozzle plate 8 (see FIG. 3).

The inventors of the present application conducted experiments to confirm the effect the parameters described above, namely, the positional displacement amount d, the presence of the flow path resistor 9, and the ratio between the height h of the flow path constituting portion 4 and the thickness l of the nozzle plate 8 have on the position where the cavitation is formed.

Details of the experiments will be described with reference to FIGS. 7A to 15D. FIGS. 7A to 7D are schematic cross-sectional views illustrating the structure of the flow paths 7 of the print heads of the plurality of comparative examples. The positional displacement amount d between the center of the ejection port 2 and the center of the heating element 1, the presence of the flow path resistor 9, and the ratio between the height h of the flow path constituting portion 4 and the thickness l of the nozzle plate 8 were different among the examples illustrated in FIGS. 7A to 7D.

As illustrated in FIGS. 7A to 7D, the positional displacement amount d of the print head in the comparative example 1 illustrated in FIG. 7A was 0 μm, that of the comparative example 2 illustrated in FIG. 7B was 6 μm, that of the comparative example 3 illustrated in FIG. 7C was 15 μm, and that of the comparative example 4 illustrated in FIG. 7D was 15 μm. In other words, with the values of the examples As illustrated in table 1, it can be understood that, in the comparative examples 1 to 3 in which l/h≤2 was satisfied, as the displacement amount d increased, the degree in which the cavitation was formed became smaller such that durability of the heating element improved. In other words, in a case in which l/h is 2 or smaller by increasing the displacement amount d between the center of the ejection port 2 and the center of the heating element 1, the load imposed on the heating element 1 by the cavitation during the disappearance of the bubble is reduced. Furthermore, as is the case of the first exemplary embodiment, it can be understood that the durability was increased further when l/h was 2 or smaller, when the displacement amount d (FIG. 4) between the center of the ejection port 2 and the center of the heating element 1 was increased, and when the flow path resistor 9 was provided. It has been found from the examination result described above that in the print head of the present exemplary embodiment, when L (FIG. 4) is the length of the heating element in the ink supply direction, the preferable range of the displacement amount d is d≥L/3.5. In the comparative examples 2 and 3, when examining the positional displacement amount d in the area in which the degree in which the cavitation was formed is x, the positional displacement amount d was about 11 μm (=the length of the long side of the heating element was 38.8/3.5). In other words, the center of the ejection port 2 and the center of the heating element 1 is spaced apart by, preferably, L/3.5 or more.

FIGS. 8A to 8D are drawings to chronologically describe the process in which the bubble disappears in the print head according to the comparative example 1 described above. FIGS. 8A to 8D are schematic cross-sectional views of the comparative example 1 viewed from above, and are cross-sectional views taken along a plane immediately above the heating element. Furthermore, FIGS. 9A to 9D are schematic cross-sectional views of the process in which the bubble disappears in the print head according to the comparative example 1.

Figure 8A:
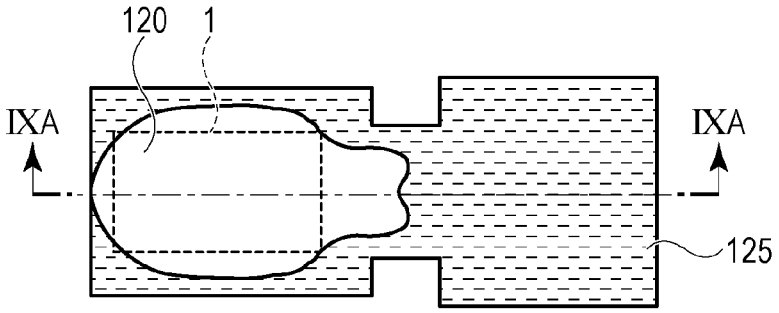
FIGS. 8A to 8D are cross-sectional views of a comparative example 1 viewed from above chronologically illustrating a state of a bubble when ejection of ink is performed.
Figure 9A:
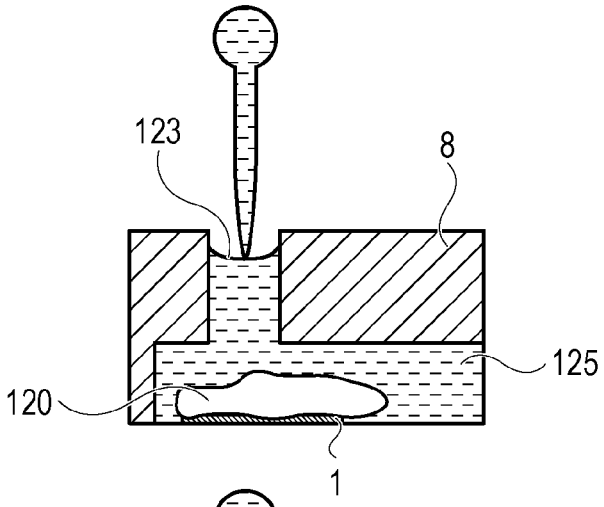
FIGS. 9A to 9D are cross-sectional views of the comparative example 1 viewed from the lateral side chronologically illustrating a state of a bubble and a meniscus when ejection of ink is performed.
Figure 9B:
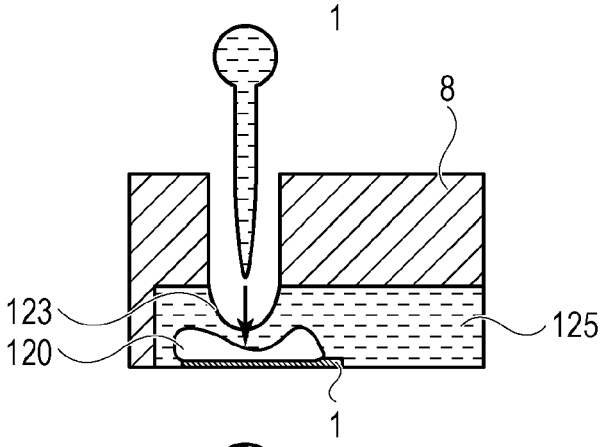
Figure 9C:
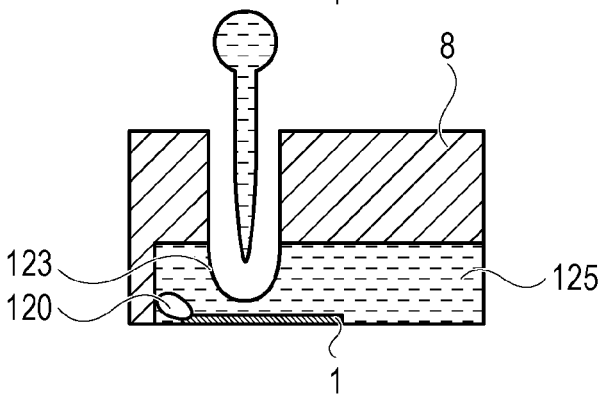
Figure 9D:
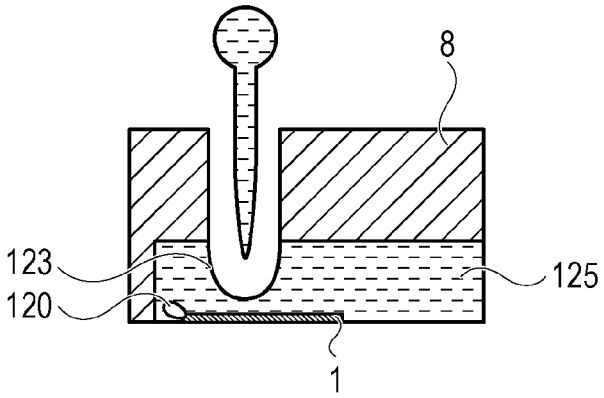

The bubble 120 that has started to form from the heating element 1 temporarily increases its volume and after reaching its maximum volume, as illustrated in FIGS. 8A and 9A, the bubble 120 shrinks. Subsequently, associated with the shrinking, the meniscus 123 of the ink positioned inside the ejecting portion 40 that is in communication with the ejection port 2 moves down towards and into the bubble forming chamber 5. When ejection of the ink is performed, ink is refilled into the bubble forming chamber 5 through the liquid flow path 7 from the ink supply ports 3 in order to replenish, into the bubble forming chamber 5, the ink amounting to the ink that has been ejected. FIGS. 9B, 9C, and 9D chronologically illustrate the disappearing bubble 120 while the meniscus 123 is moving down. In the present comparative example 1, since the ejection port 2 is disposed so that the center of the ejection port 2 is disposed at the center of the heating element 1, the meniscus 123 moves down to the center area of the heating element 1 and the ink 125 is replenished.

Figure 8B:
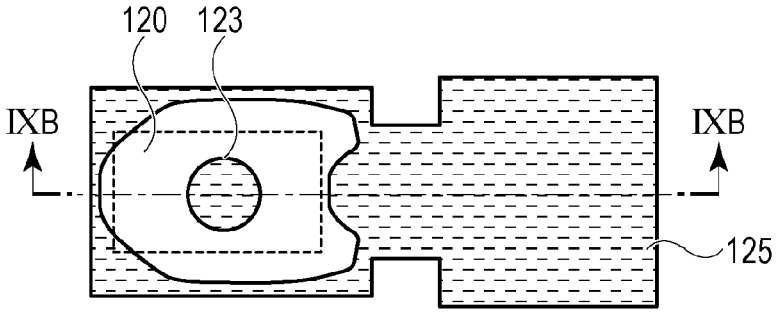

FIG. 9B illustrates a state around the ejection port 2 when the meniscus 123 has moved down into the bubble forming chamber 5 through the ejecting portion 40. Furthermore, FIG. 8B illustrates a cross-sectional view of the portion extending along the plane immediately above the heating element 1 in the above state. In the center area of the bubble forming chamber 5 illustrated in FIG. 8B, the bubble is, upon lowering of the meniscus 123, contracted while being squashed. Accordingly, the shape of the bubble 120 turns into the shape illustrated in FIG. 8B.

Figure 8C:
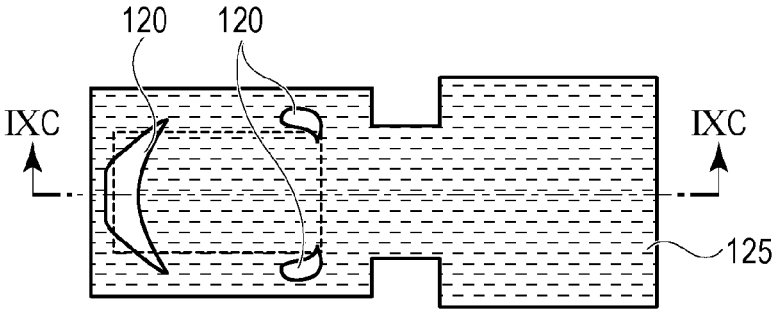
Figure 8D:
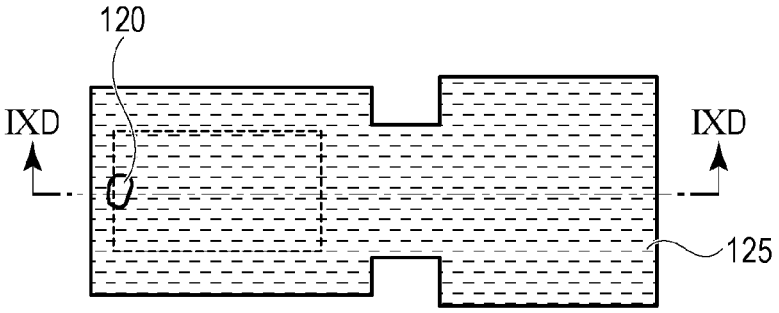

As illustrated in FIGS. 8C and 8D, in the state of the bubble 120 and the meniscus 123 immediately before the bubble disappears, since the ejection port 2 is disposed such that the center of the ejection portion 2 is positioned at the center of the heating element 1, the bubble 120 is divided by the meniscus 123 while the bubble is disappearing. Accordingly, divided bubbles are formed in the far side area close to the wall surface of the bubble forming chamber 5. Furthermore, as illustrated in FIGS. 8C and 8D, since the bubble ultimately disappears on the heating element 1 without atmospheric communication, the cavitation is formed on the heating element 1.

Figure 10A:
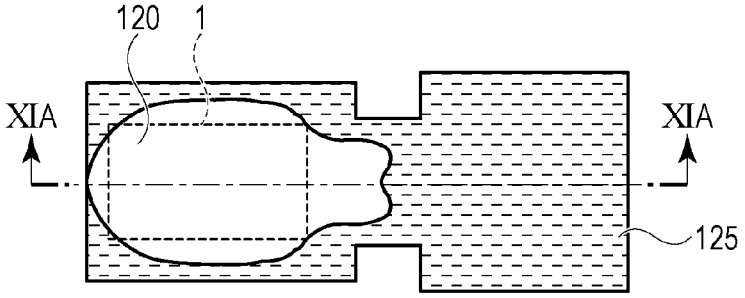
FIGS. 10A to 10D are cross-sectional views of a comparative example 2 viewed from above chronologically illustrating a state of a bubble when ejection of ink is performed.
Figure 10B:
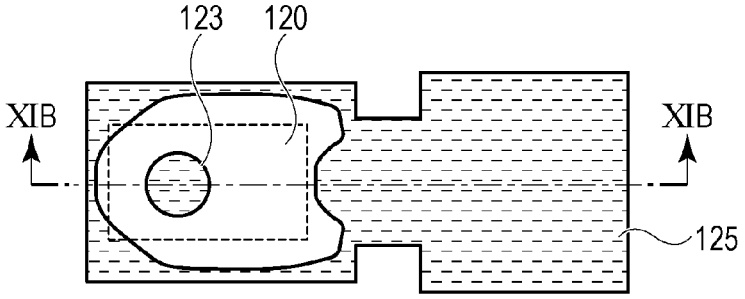
Figure 10C:
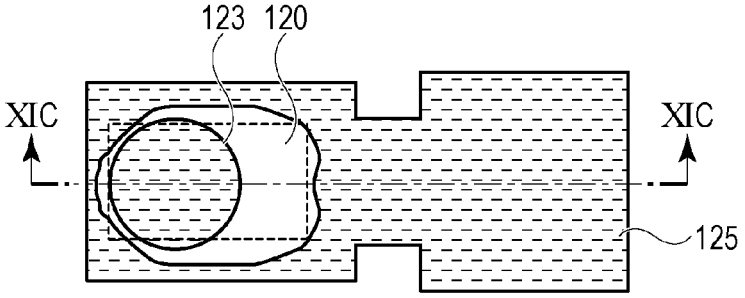
Figure 10D:
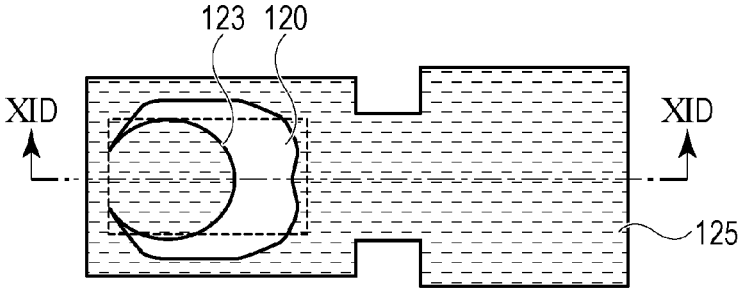
Figure 11A:
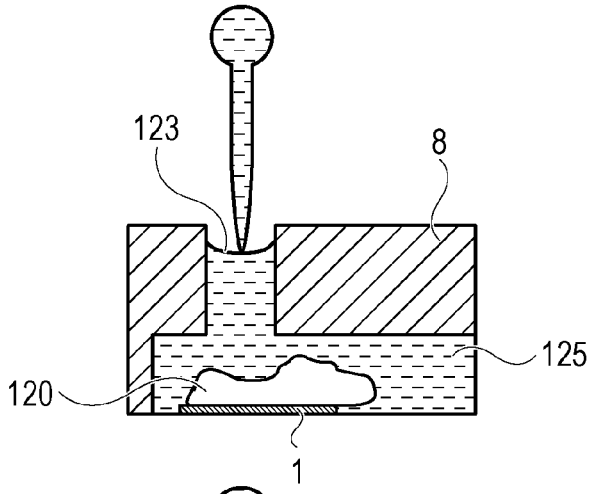
FIGS. 11A to 11D are cross-sectional views of the comparative example 2 viewed from the lateral side chronologically illustrating a state of a bubble and a meniscus when ejection of ink is performed.

FIGS. 10A to 10D are drawings to chronologically describe the process in which the bubble disappears in the print head according to the comparative example 2. FIGS. 10A to 10D are schematic cross-sectional views of the comparative example 2 viewed from above, and are cross-sectional views taken along a plane immediately above the heating element. Furthermore, FIGS. 11A to 11D are schematic cross-sectional views of the process in which the bubble disappears in the print head according to the comparative example 2. The bubble 120 that has started to form from the heating element 1 temporarily increases its volume and after reaching its maximum volume, as illustrated in FIGS. 10A and 11A, the bubble 120 shrinks. Subsequently, associated with the above, the meniscus 123 of the ink positioned inside the ejecting portion 40 that is in communication with the ejection port 2 moves down towards and into the bubble forming chamber 5. Furthermore, when ink is ejected, ink is refilled in the bubble forming chamber 5.

Figure 11B:
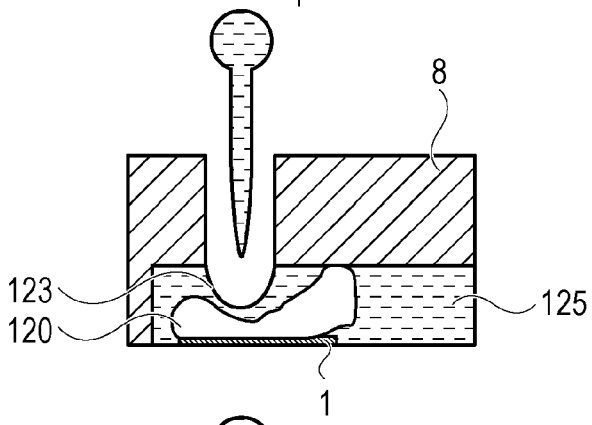
Figure 11C:
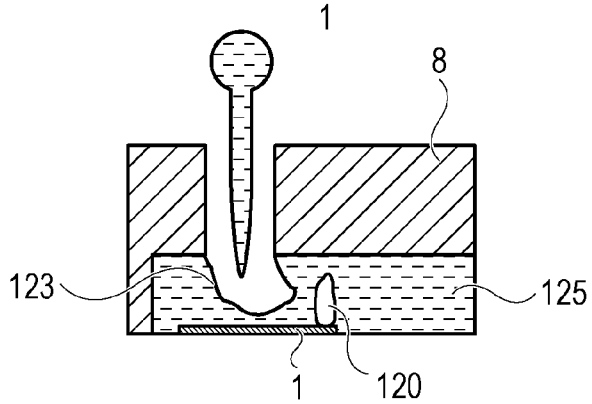
Figure 11D:
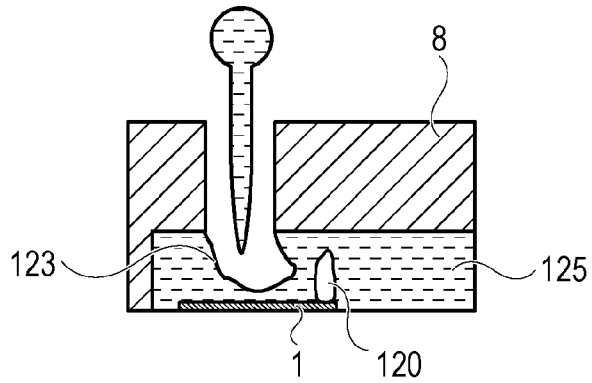

FIGS. 11B, 11C, and 11D chronologically illustrate the disappearing bubble 120 while the meniscus 123 is moving down. In the present comparative example 2, the ejection port 2 is disposed such that the center of the ejection port 2 is displaced 6 μm with respect to the center of the heating element 1 in the ink supplying direction extending from the ink supply port 3 to the bubble forming chamber 5. Accordingly, the meniscus 123 moves down and ink 125 is replenished at the end portion area of the heating element 1 on the wall surface side of the bubble forming chamber 5.

A cross-sectional view illustrating a state around the ejection port 2 when the meniscus 123 has moved down into the bubble forming chamber 5 through the ejecting portion 40 is illustrated in FIG. 11B. Furthermore, a cross-sectional view of the portion extending along the plane immediately above the heating element 1 in the above state is illustrated in FIG. 10B. In the end portion area of the bubble forming chamber 5 on the wall surface side illustrated in FIG. 10B, the bubble is, upon lowering of the meniscus 123, contracted while being squashed. Accordingly, the shape of the bubble 120 turns into the shape illustrated in FIG. 10B.

The state of the bubble 120 and the meniscus 123 immediately before the bubble disappears will be illustrated next in FIGS. 10C and 10D, and a cross-sectional view of the portion extending along a plane immediately above the heating element 1 in the above state is illustrated in FIGS. 11C and 11D. As illustrated above, in the present comparative example 2, the ejection port 2 is disposed so that the center of the ejection port 2 is displaced 6 μm with respect to the center of the heating element 1. Accordingly, while the bubble is disappearing, the bubble 120 is divided by the meniscus 123 at the end portion area on the heating element 1 near the wall surface side of the bubble forming chamber 5. In the mode of the present comparative example 2, the shape of the tip of the bubble 120 is thinner than that of the comparative example 1, and the divided bubble is finer. As illustrated in FIGS. 10C and 10D, similar to the comparative example 1, since the bubble ultimately disappears on the heating element 1 without atmospheric communication, the cavitation is formed on the heating element 1.

Figure 12A:
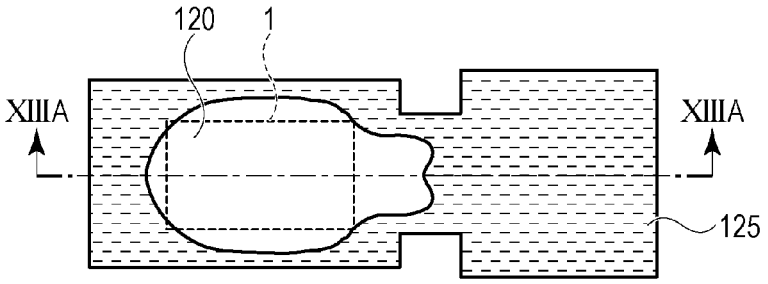
FIGS. 12A to 12D are cross-sectional views of a comparative example 3 viewed from above chronologically illustrating a state of a bubble when ejection of ink is performed.
Figure 12B:
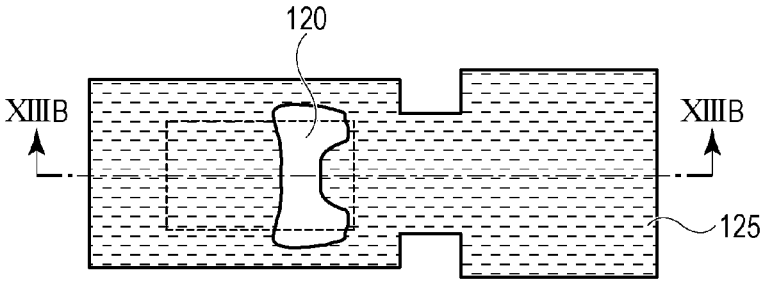
Figure 12C:
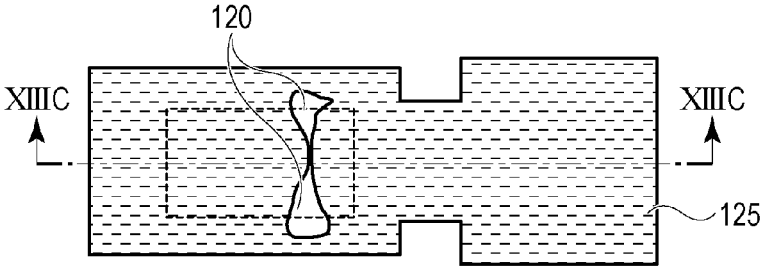
Figure 12D:
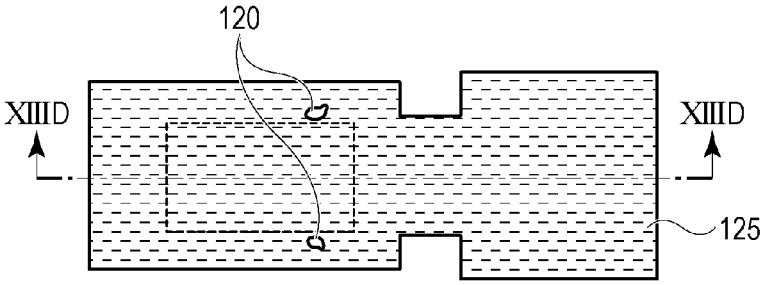
Figure 13A:
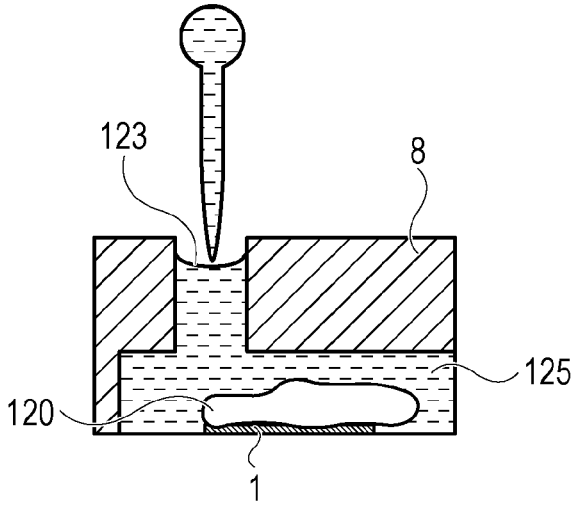
FIGS. 13A to 13D are cross-sectional views of the comparative example 3 viewed from the lateral side chronologically illustrating a state of a bubble and a meniscus when ejection of ink is performed.
Figure 13B:
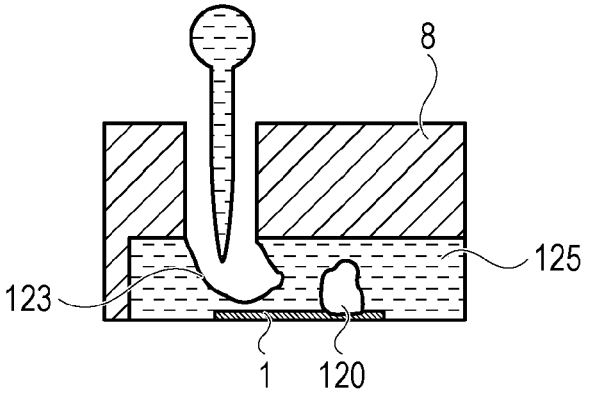
Figure 13C:
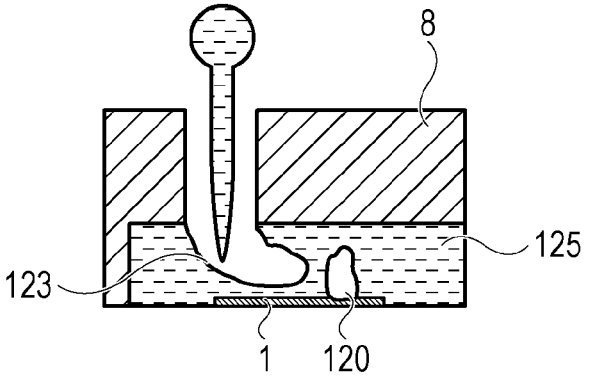
Figure 13D:
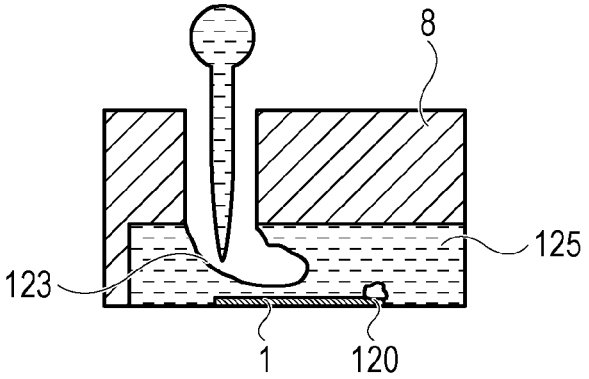

FIGS. 12A to 12D are drawings to chronologically describe the process in which the bubble disappears in the print head according to the comparative example 3. FIGS. 12A to 12D are schematic cross-sectional views of the print head viewed from above, and are cross-sectional views illustrating a portion taken along a plane immediately above the heating element. Furthermore, FIGS. 13A to 13D are schematic cross-sectional views of the process in which the bubble disappears in the print head according to the comparative example 3. The bubble 120 that has started to form from the heating element 1 temporarily increases its volume and after reaching its maximum volume, as illustrated in FIGS. 12A and 13A, the bubble 120 shrinks. Subsequently, associated with the above, the meniscus 123 of the ink positioned inside the ejecting portion 40 that is in communication with the ejection port 2 moves down towards and into the bubble forming chamber 5. When ink is ejected, ink is refilled in the bubble forming chamber 5. FIGS. 13B, 13C, and 13D chronologically illustrate the disappearing bubble 120 while the meniscus 123 is moving down. In the present comparative example 3, the ejection port 2 is disposed such that the center of the ejection port 2 is displaced 15 μm with respect to the center of the heating element 1 in the ink supplying direction extending from the ink supply port 3 to the bubble forming chamber 5. Accordingly, the meniscus 123 moves down and ink 125 is replenished at the end portion area of the heating element 1 on the wall surface side of the bubble forming chamber 5.

A cross-sectional view illustrating a state around the ejection port 2 when the meniscus 123 has moved down into the bubble forming chamber 5 through the ejecting portion 40 is illustrated in FIG. 13B. Furthermore, a cross-sectional view of the portion extending along the plane immediately above the heating element 1 in the above state is illustrated in FIG. 12B. In the end portion area of the bubble forming chamber 5 on the wall surface side illustrated in FIG. 12B, the bubble is, upon lowering of the meniscus 123, contracted while being squashed. However, different from the comparative example 2, since the ejection port 2 is positioned so as to be displaced by a large distance, that is, by 15 μm, different from the exemplary embodiment of the comparative example 2, there is no bubble 120 at the end portion area of the bubble forming chamber 5 on the wall surface side. Accordingly, as illustrated in FIG. 13B, the bubble 120 is present unevenly on the ink supply port side of the heating element 1 and the meniscus 123 being drawn by the negative pressure of the bubble 120 is deviated. Furthermore, while the ink is being refilled from the ink supply ports 3, since the flow velocity of the middle portion of the flow path 7 is higher, the bubble 120 turns into a shape illustrated in FIG. 12B.

The state of the bubble 120 and the meniscus 123 immediately before the bubble disappears will be illustrated next in FIGS. 12C and 12D, and a cross-sectional view of the portion extending along a plane immediately above the heating element 1 in the above state is illustrated in FIGS. 13C and 13D. Illustrated with a broken line is the outer peripheral area of the heating element 1. When time further elapses from the state illustrated in FIG. 12B, the bubble is divided starting from the point near the middle of the flow path 7 on the ink supply port side of the heating element 1 where the bubble is thinner. The fine bubbles (not shown) formed by being divided above disappear on the heating element 1 without atmospheric communication; accordingly, the cavitation is formed. In the state illustrated in FIG. 12D in which time has further elapsed, the bubble 120 that has been vertically divided ultimately disappears.

As described above, as illustrated in FIGS. 10C and 10D, in the present comparative example 3, since the bubble disappears on the heating element 1 without atmospheric communication, the degree of damage is, compared with the comparative examples 1 and 2, lighter even though the cavitation is formed on the heating element 1.

A case of the print head according to the comparative example 4 having a thick nozzle plate will be described next. When the thickness of the nozzle plate is 1, and the length (height) of the flow path 7 and the bubble forming chamber 5 in the ink ejection direction is h, the comparative examples 1 to 3 described above all satisfy $l/h \leq 2$. In the examination result in table 1, in the case of the comparative examples 1 to 3 that satisfy $l/h \leq 2$, as the ejection port 2 is offset from the center of the heating element 1, the durability improves. However, in a case of the comparative example 4 satisfying $l/h > 2$, the tendency differs. Hereinafter, the above case will be described.

FIGS. 14A to 14D are cross-sectional views chronologically describing the process in which the bubble disappears in the print head according to the comparative example 4. FIGS. 15A to 15D are schematic cross-sectional views of the print head illustrating the disappearance process of the bubble of the print head viewed from above, and are cross-sectional views illustrating a portion taken along a plane immediately above the heating element 1.

Figure 14A:
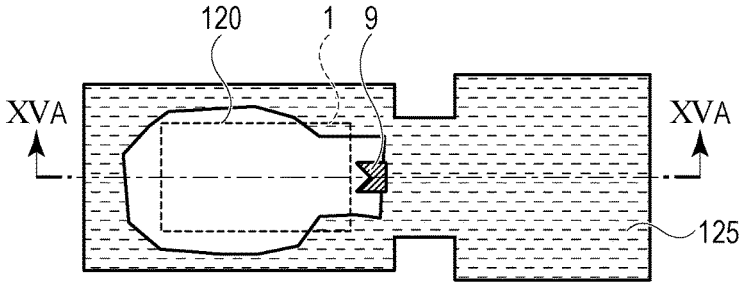
FIGS. 14A to 14D are cross-sectional views of a comparative example 4 viewed from above chronologically illustrating a state of a bubble when ejection of ink is performed.
Figure 15A:
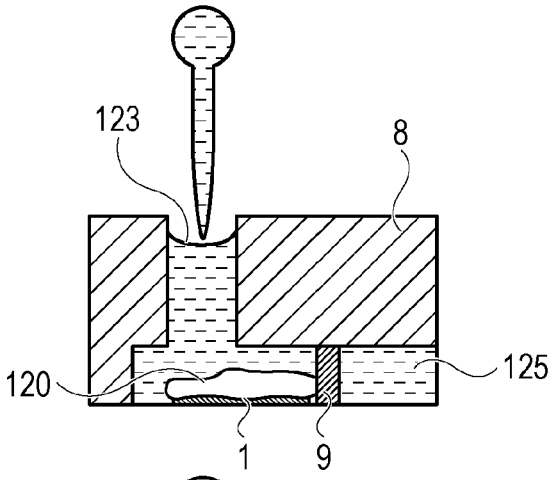
FIGS. 15A to 15D are cross-sectional views of the comparative example 4 viewed from the lateral side chronologically illustrating a state of a bubble and a meniscus when ejection of ink is performed.

In the print head according to the present comparative example 4, as illustrated in FIG. 7D and similar to the first exemplary embodiment, the ejection port 2 is disposed such that the center of the ejection port 2 is displaced 15 μm with respect to the center of the heating element 1 in the ink supplying direction extending from the ink supply port 3 to the bubble forming chamber 5. Furthermore, a flow path resister that has the same shape as that of the first exemplary embodiment is provided at the same position as that of the first exemplary embodiment. After the formation of the bubble 120 is stated, the volume thereof is temporarily increased, and the maximum volume thereof is reached, as illustrated in FIGS. 14A and 15A, the bubble 120 shrinks. Subsequently, associated with the above, the meniscus 123 of the ink positioned inside the ejecting portion 40 that is in communication with the ejection port 2 moves down towards and into the bubble forming chamber 5. At this point, since the flow path resistor 9 illustrated in FIG. 14A is disposed at a position that is relatively close to the heating element 1, the recessed portion of the flow path resistor 9 is filled with the bubble 120 that has developed through bubbling.

The state in the above case in which the meniscus 123 starts to move down is illustrated in FIG. 15A. In the case of the present example in which the relationship between the thickness of the ejection portion and the height of the liquid flow path 7 and the bubble forming chamber 5 is $l/h > 2$, since the thickness l of the nozzle plate 8 is large, the surface position of the meniscus 123 is higher compared to that of the first exemplary embodiment.

Figure 14B:
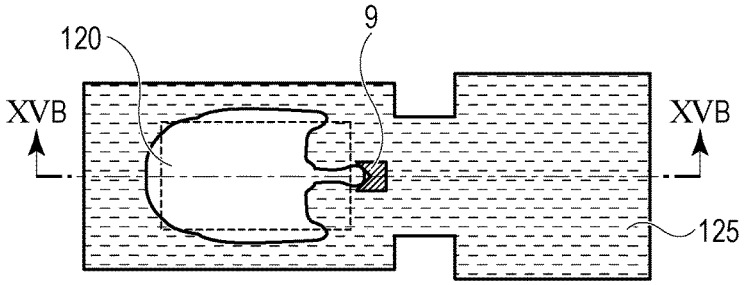
Figure 15B:
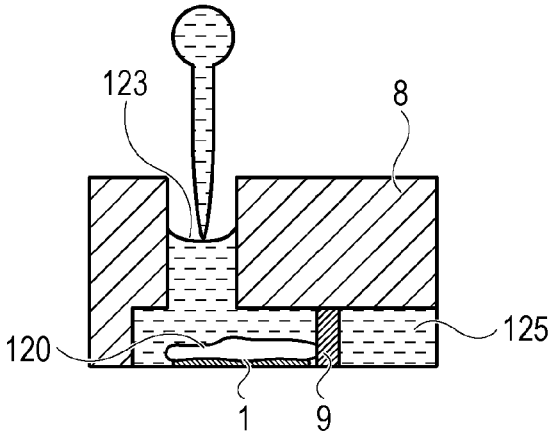

A state in which the meniscus 123 has moved further down is illustrated in FIGS. 14B and 15B. In the mode of the present comparative example 4, different from the mode of the first exemplary embodiment, since the thickness l of the nozzle plate 8 is large, compared with the state illustrated in FIG. 6B related to the first exemplary embodiment, the surface position of the meniscus 123 is high and the meniscus 123 has not yet entered the inside of the bubble forming chamber 5. Accordingly, when FIG. 14B and FIG. 5B are compared with each other, in the present comparative example, the bubble 120 is less affected by the deformation of the meniscus 123 associated with the meniscus 123 moving down. As a result, the bubble 120 is present, as it has been, at the end portion area of the bubble forming chamber 5 on the wall surface side. Meanwhile, in the area of the bubble forming chamber 5 closed to the ink supply port 3, ink 125 is refilled into the bubble forming chamber 5 from the ink supply port 3 through the liquid flow path 7. However, since the bubble 120 is adhered to the recessed portion of the flow path resistor 9, refilling of the ink 125 in the area in the middle portion where the flow path resistor 9 is positioned is delayed compared to the end portion. Accordingly, the shape of the bubble 120 turns into the shape illustrated in FIG. 14B.

Figure 14C:
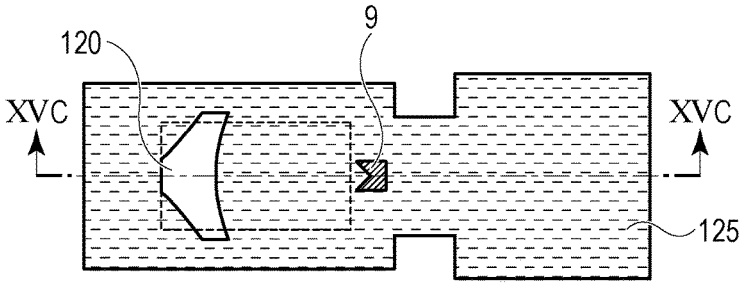
Figure 15C:
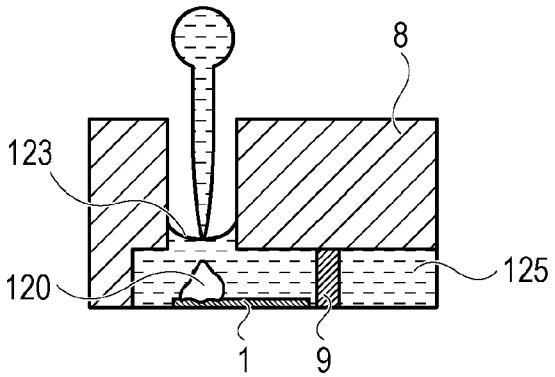

A state in which the meniscus 123 has moved further down is illustrated in FIGS. 14C and 15C. In the present comparative example 4, different from the mode of the first exemplary embodiment, since the thickness l of the nozzle plate 8 is large, compared with the state illustrated in FIG. 6B related to the first exemplary embodiment, the surface position of the meniscus 123 is high and the meniscus 123 has not yet entered the inside of the bubble forming chamber 5. In the mode of the present comparative example 4, the volume of the bubble 120 of the heating element 1 on the wall surface side of the bubble forming chamber 5 is larger when compared with that of the mode of the first exemplary embodiment. Accordingly, in FIG. 14B, the bubble 120 adheres to the flow path resistor 9 such that the ink is elongated, and the bubble 120 is cut off while the bubble 120 is contracted. As illustrated in FIG. 15C, the bubble 120 on the wall surface side of the bubble forming chamber 5 remains and eventually disappears.

Figure 14D:
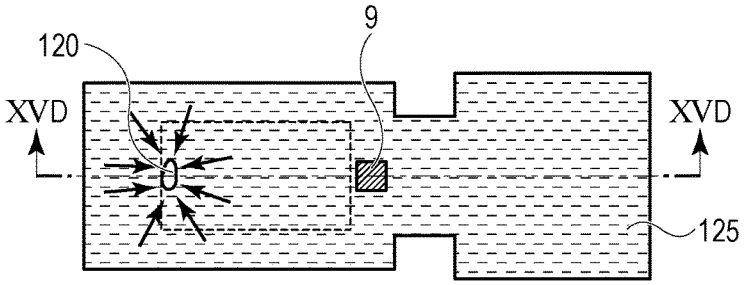
Figure 15D:
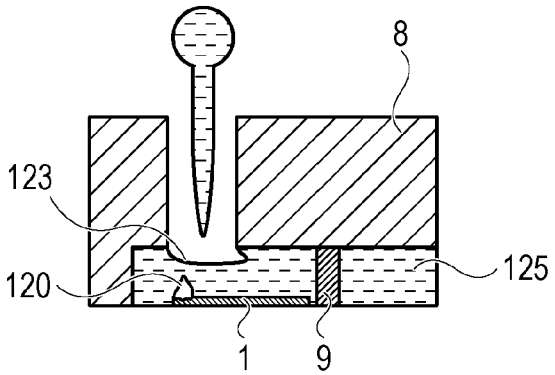

The state of the bubble 120 and the meniscus 123 immediately before the bubble disappears will be illustrated next in FIG. 14D, and a cross-sectional view of the portion extending along a plane immediately above the heating element 1 in the above state is illustrated in FIG. 15D. When time further elapses from the state illustrated in FIG. 14C, ultimately, the bubble 120 at the end portion area of the heating element 1 on the wall surface side disappears. In the present comparative example 4 in which the relationship between the thickness of the ejecting portion and the height of the flow path 7 and the bubble forming chamber 5 is l/h>2, since the thickness l of the nozzle plate 8 is large, even at the time in FIG. 15D when the bubble ultimately disappears, the amount in which the meniscus 123 protrudes into the bubble forming chambers 5 is small. Furthermore, at this point, since the bubble 120 disappears on the heating element 1 without atmospheric communication, the cavitation is formed.

With the examination results above, it is understood that the three parameters described above are important to suppress cavitation from being formed on the heating element 1.

Figure 16A:
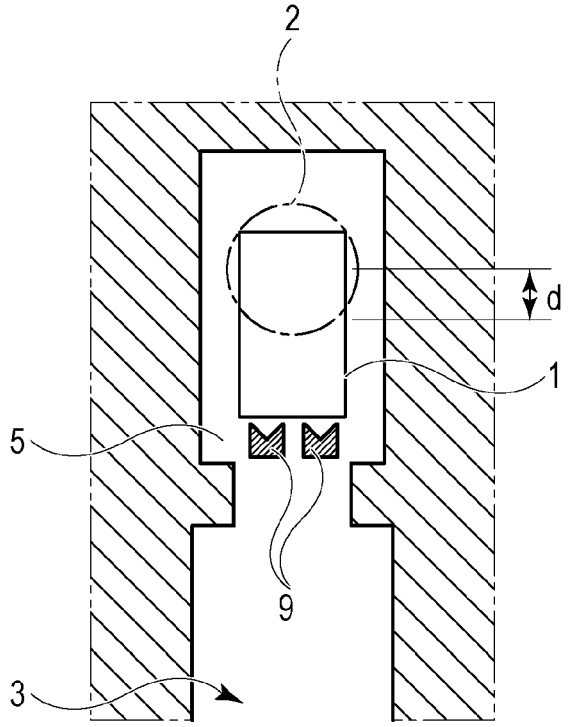
FIGS. 16A to 16B are cross-sectional views illustrating a state around the ejection port of the print head according to a modification of the first exemplary embodiment of the present disclosure.
Figure 16B:
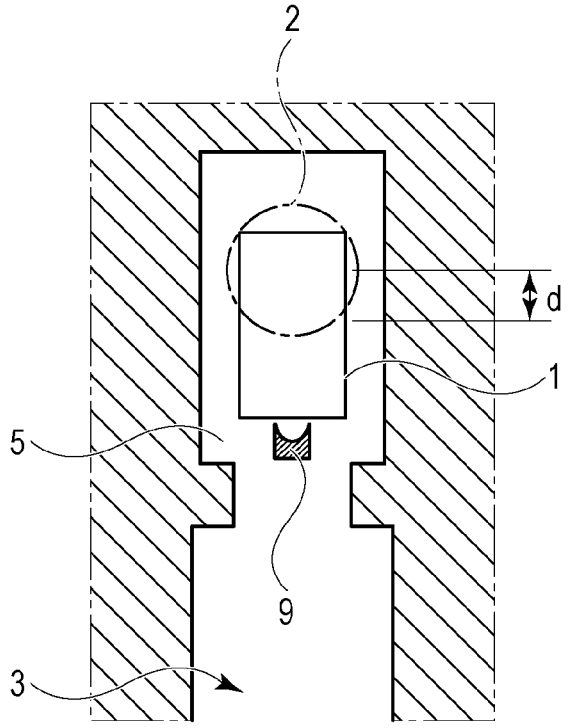

Note that a similar effect can be obtained with the mode illustrated in FIG. 16A in which the number of flow path resistors are increased, and with a mode illustrated in FIG. 16B in which the ink contact surface of the flow path resistor 9 has a curved surface shape.

Furthermore, the shape of the ejection port is not limited to a circle and may be an elliptic shape or may include a protrusion. Furthermore, the flow path 7 does not necessarily have a symmetrical shape, and a flow path with an asymmetrical shape or with an uneven shape may be applied to the present disclosure. In such a case, the position where the center of gravity of the cross-section (orthogonal to the direction in which the liquid is ejected) of the ejection port exist is used as the position of the center of the ejection port. Furthermore, in the exemplary embodiment described above, a rectangular heating element is used; however, the heating element is not limited to a rectangular one. A heating element having a different shape may be used. In such a case, the position of the center of gravity of the surface of the heating element is used as the center of the heating element.

Furthermore, the recording device described above is a so-called serial scan type recording device that records an image by moving the print head in the main scanning direction and by conveying the recording medium in the sub-scanning direction. However, the present disclosure may be applied to a full-line type recording device that uses a print head that extends across the entire area of the recording medium in the width direction.

Furthermore, "recording" in the present description is used not only in cases in which meaningful information, such as a character and a figure, is formed, but various cases, regardless of whether the information formed is meaningful or meaningless, may be included. Furthermore, "recording" may also include cases, regardless of whether it can be manifested so that a person can perceive it through visual sensation, in which an image, a design, a pattern, and the like are formed on a record medium, or cases in which the record medium is processed.

Furthermore, "recording device" includes a device including a printing function, such as a printer, a printer composite machine, a copying machine, and a facsimile apparatus, and a manufacturing apparatus that performs manufacturing of articles using an ink jet technology.

Furthermore, "record medium" not only refers to paper that is used in typical recording devices but also refers to fabric, a plastic film, a metal sheet, glass, ceramics, wood, leather, and the like that are capable of accepting ink.

Furthermore, "ink" (or "liquid") may be interpreted in a broad manner similar to the definition of "recording" described above. "Ink" (or "liquid") may denote a liquid that is capable of being used by being applied onto a record medium to form an image, a design, a pattern, and the like and, furthermore, may be a liquid used in processing the record medium or for processing ink (for coagulating or insolubilizing a colorant in the ink applied to a record medium, for example).

Second Exemplary Embodiment

In a second exemplary embodiment of the present disclosure, an offset amount (d) of the ejection port 2 with respect to the heating element 1 in the direction in which the ink is supplied in the pressure chamber 5 is 12 μm. A length of the heating element 1 in a direction orthogonal to the supply direction is 27.4 μm and a length thereof in the supply direction is 34.4 μm. The heating element 1 has a rectangular shape in which the aspect ratio is 1.24(=34.4/27.4). The flow path resistor 9 is a square measuring 6 μm on each side. The closest end of the heating element 1 to the center of the flow path resistor 9 is 5.85 μm. Accordingly, the distance between the closest end of the heating element 1 to the liquid contact surface of the flow path resistor 9 on the side close to the heating element 1 is 2.85 μm. Note that a similar effect to that of the present exemplary embodiment can be obtained when the distance is 2.85 μm or smaller.

FIGS. 17A to 17D are schematic cross-sectional views for chronologically describing the process in which the bubble disappears when ejecting ink with the print head according to the second exemplary embodiment of the present disclosure and are cross-sectional views of the heating element 1 taken along a plane immediately above the heating element 1. The cross-sectional views viewed from the lateral side and taken along lines VIA-VIA, VIB-VIB, VIC-VIC, and VID-VID in FIGS. 17A, 17B, 17C, and 17D, respectively, are the same as those of the first exemplary embodiment and reference will be made to FIGS. 6A, 6B, 6C, and 6D.

Figure 17A:
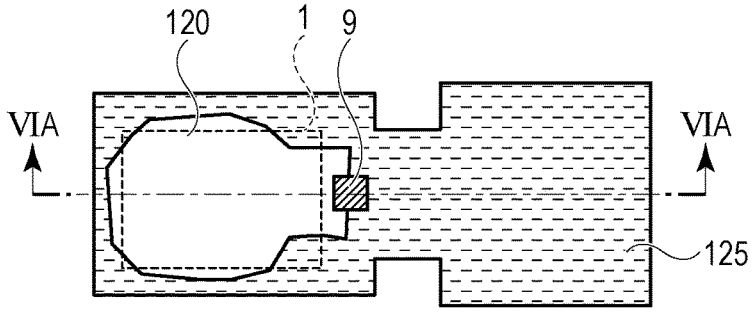
FIGS. 17A to 17D are cross-sectional views illustrating a state around the ejection port of the print head according to a second exemplary embodiment of the present disclosure.

The bubble 120 is formed on the heating element 1 with the heat generated by the heating element 1, the bubble 120 generated by heating develops and with the bubbling pressure at this point, a portion of the ink retained in the bubble forming chamber 5 is ejected from the ejection port 2. After increase in the volume of the bubble 120 reaching its maximum volume in the above manner, as illustrated in FIG. 17A, upon contraction of the bubble 120, the meniscus 123 (see FIGS. 6A to 6D, the same applies hereinafter) of the ink positioned inside the ejecting portion 40 in communication with the ejection port 2 moves down towards and into the bubble forming chamber 5. At this point, since the flow path resistor 9 illustrated in FIG. 17A is disposed at a position that is relatively close to the heating element 1, the bubble 120 that has developed through bubbling is completely adhered to the straight portion of the flow path resistor 9.

Figure 17B:
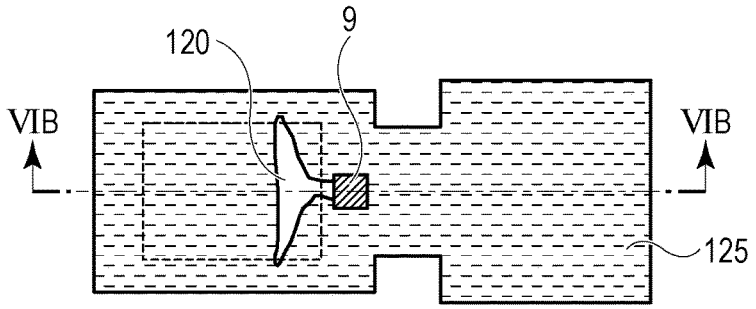

As illustrated in FIG. 17B, next, when the meniscus 123 moves down in the bubble forming chamber 5 through the ejecting portion 40, the far side area of the bubble 120 close to the wall surface of the bubble forming chamber 5 is contracted while being squashed. Meanwhile, in the area of the bubble forming chamber 5 closed to the ink supply port 3, ink 125 is refilled into the bubble forming chamber 5 from the ink supply port 3 through the liquid flow path 7.

However, since the bubble 120 is adhered to the straight portion of the flow path resistor 9, refilling of the ink 125 in the area in the middle portion where the flow path resistor 9 is positioned is delayed compared to the end portion. Accordingly, the shape of the bubble 120 turns into the shape illustrated in FIG. 17B.

Figure 17C:
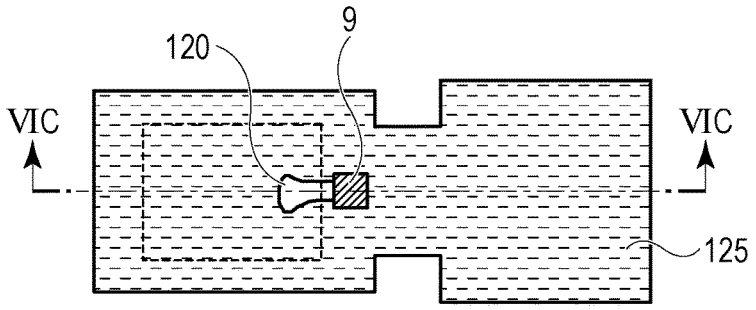
Figure 17D:
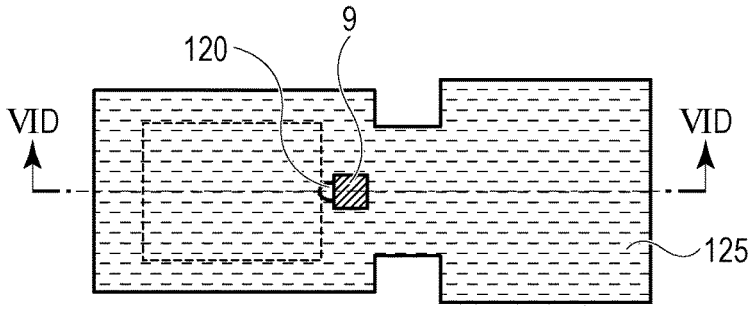

The state of the bubble 120 and the meniscus 123 immediately before the bubble disappears will be illustrated next in FIGS. 17C and 17D using a cross-sectional view of the portion extending along a plane immediately above the heating element 1. Illustrated by a broken line portion is the outer peripheral area of the heating element 1. In the present exemplary embodiment, the ejection port 2 is disposed such that the center of the ejection port 2 is greatly displaced with respect to the center of the heating element 1 in the ink supplying direction extending from the ink supply port 3 to the bubble forming chamber 5, and the bubble 120 is not easily divided with the meniscus 123 during the bubble disappearing process. Accordingly, divided bubbles do not form in the far side area close to the wall surface of the bubble forming chamber 5. Furthermore, as illustrated in FIGS. 17C and 17D, the bubble ultimately disappears at a position near the flow path resistor 9 and outside the heating element 1 without atmospheric communication.

As described above, due to the effect of the flow path resistor 9, the position where the bubble 120 disappear is outside the heating element 1; accordingly, the impact on the heating element 1 acting on a single location in a concentrated manner can be averted. Accordingly, load being applied to the heating element 1 can be suppressed and the effect caused by cavitation can be reduced.

The inventors of the present application conducted experiments to confirm the effect of the distance between the flow path resistor 9 and the heating element 1, and the shape of the flow path resistor on the position where the cavitation is formed, in order to move the bubble disappearing position outside the heating element 1 after the bubble 120 has been formed inside the bubble forming chamber 5.

Here, the print heads of the first exemplary embodiment, the second exemplary embodiment, a comparative example 5, and a comparative example 6 were used to confirm the degree in which the cavitation was formed in the flow path 7 during the ejection of ink, and whether there was any damage to the heating element 1 during the ejection durability test were confirmed. The result of the confirmation will be described in table 2.

TABLE 2

| | First Exemplary Embodiment | Second Exemplary Embodiment | Comparative Example 5 | Comparative Example 6 |
|---|---|---|---|---|
| Positional Displacement Amount d (μm) | 15 | 12 | 15 | 15 |
| Shortest Distance from Flow Path Resistor to End of Heating Element | 2.85 μm | 2.85 μm | 3 μm | 6 μm |
| Shape of Liquid Contact Surface of Flow Path Resistor | Recess | Straight Line | Protrusion (Circular) | Recess |
| Length of Long Side of Heating Element | 38.8 μm | 34.4 μm | 38.8 μm | 38.8 μm |
| Degree in which Cavitation was Formed | ○ | ○ | x | x |

Figure 18A:
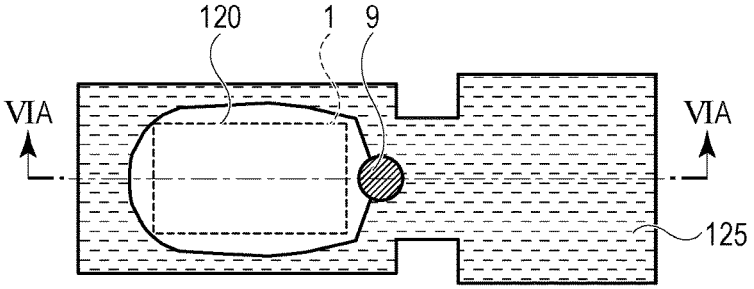
FIGS. 18A to 18D are cross-sectional views of a comparative example 5 viewed from above chronologically illustrating a state of a bubble when ejection of ink is performed.
Figure 18B:
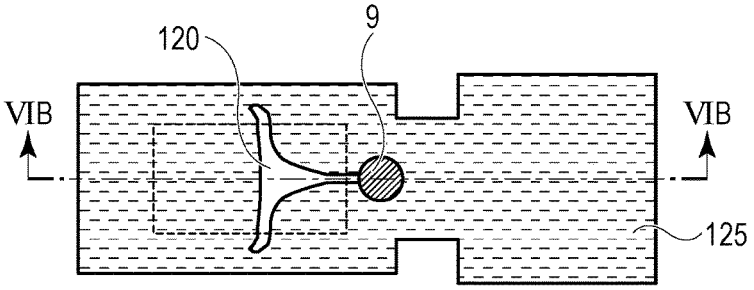
Figure 18C:
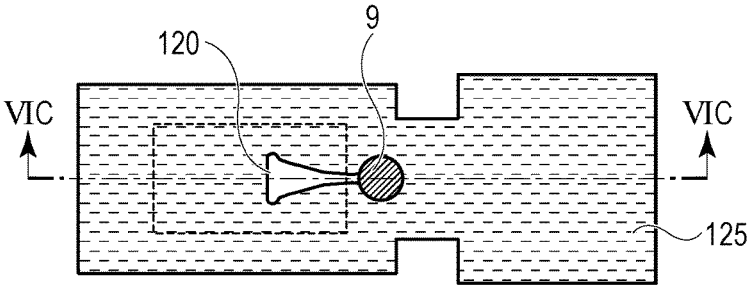
Figure 18D:
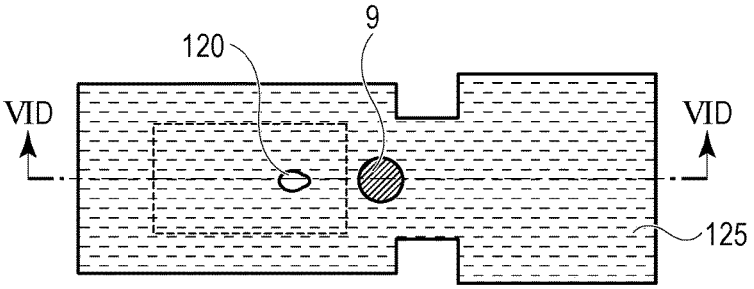

The effect of the shape of the liquid contact surface of the flow path resistor 9 on the position where the cavitation is formed will be described first. FIGS. 18A to 18D are schematic cross-sectional views for chronologically describing the process in which the bubble disappears when ejecting ink with the print head according to the comparative example 5 and are cross-sectional views of the heating element 1 of a portion extending along a plane immediately above the heating element 1. Since the cross-sectional views viewed form the lateral side and taken along lines VIA-VIA, VIB-VIB, VIC-VIC, and VID-VID in FIGS. 18A, 18B, 18C, and 18D, respectively, are the same as those of the first exemplary embodiment, description thereof is omitted. Comparing with FIG. 5A according to the first exemplary embodiment, in the present comparative example 5, the flow path resistor has a columnar shape, and the shortest distance between the flow path resistor 9 and the heating element 1 is substantially the same as that of the comparative example 5. At this point, since the flow path resistor 9 illustrated in FIG. 18A is disposed at a position that is relatively close to the heating element 1, the bubble 120 that has developed through bubbling is completely adhered to the surface portion of the flow path resistor 9. However, since the flow path resistor 9 has a columnar shape, the flow velocity of the ink flowing towards the bubble forming chamber 5 that is a portion close to the flow path resistor 9 is, compared with that of the recessed shape of the flow path resister of the first exemplary embodiment, faster. Furthermore, the area where the flow velocity of the ink flowing towards the bubble forming chamber 5 is fast is large. Accordingly, as illustrated in FIG. 18B, the length of the bubble 120 that adheres to the circular (protruded) portion of the flow path resistor 9 tends to be, compared with that of the flow path resistor with a recessed shape, shorter. As a result, as illustrated in FIGS. 18C and 18D, the ultimate bubble disappearing position is a position above the heating element 1, and the cavitation is formed on the heating element 1. From the result of the present comparative example 5, it can be said that compared with the flow path resistor 9 of the first exemplary embodiment with a recessed shape, the effect of controlling the bubble disappearing position of the bubble to the outside of the heating element 1 is smaller with the flow path resistor 9 with a columnar (protruded) shape.

The effect of the position of the liquid contact surface of the flow path resistor 9 on the position where the cavitation is formed will be described next. FIGS. 19A to 19D are schematic cross-sectional views for chronologically describing the process in which the bubble disappears when ejecting ink with the print head according to the comparative example 6 and are cross-sectional views of the heating element 1 of a portion extending along a plane immediately above the heating element 1. Since the cross-sectional views viewed from the lateral side and taken along lines VIA-VIA, VIB-VIB, VIC-VIC, and VID-VID in FIGS. 19A, 19B, 19C, and 19D, respectively, are the same as those of the first exemplary embodiment, description thereof is omitted. Compared with FIG. 5A according to the first exemplary embodiment, in the comparative example 6, the shapes of the flow path resistors are the same, and the distance between the flow path resistor 9 and the heating element 1 is 3.15 μm longer than that of the first exemplary embodiment.

Figure 19A:
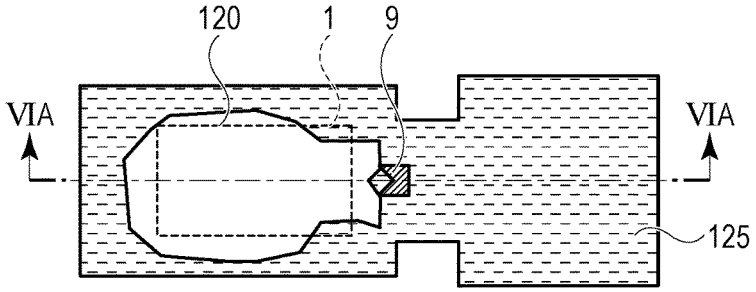
FIGS. 19A to 19D are cross-sectional views of a comparative example 6 viewed from above chronologically illustrating a state of a bubble when ejection of ink is performed.
Figure 19B:
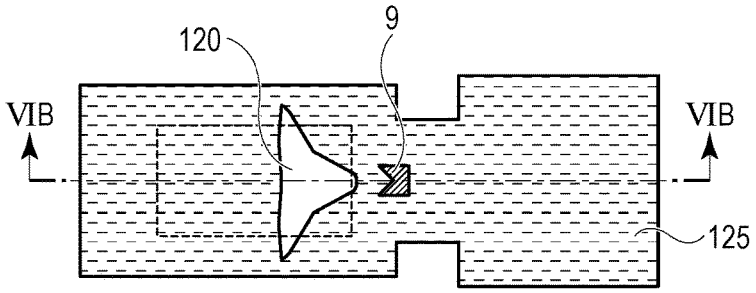
Figure 19C:
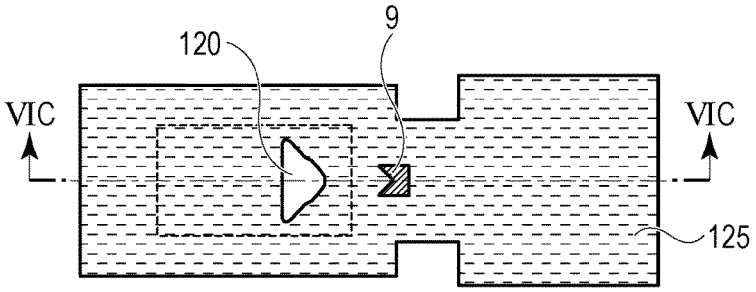
Figure 19D:
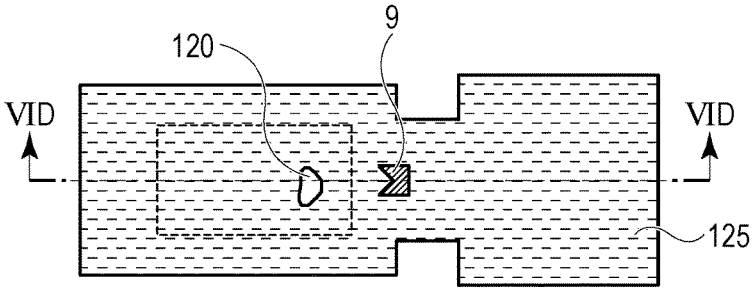

Different from the first exemplary embodiment, as illustrated in FIG. 19A, in the present comparative example 6, the flow path resistor 9 is disposed at a position that is farther away from the heating element 1. Accordingly, the bubble 120 that has developed due to bubbling does not completely adhere to the recessed portion of the flow path resistor 9. Accordingly, as illustrated in FIG. 19B, no bubble 120 adheres to the flow path resistor 9, and since the position where the bubble 120 disappears has a smaller effect in controlling the bubble compared to the first exemplary embodiment, the bubble 120 has a tendency to move towards the wall surface of the bubble forming chamber 5. As a result, as illustrated in FIGS. 19C and 19D, the ultimate bubble disappearing position is a position above the heating element 1, and is a position where the cavitation is formed. From the result of the present comparative example 6, it can be said that even when the flow path resistor 9 of the first exemplary embodiment with a recessed shape is used, for those in which the position of the flow path resistor 9 is relatively far, the effect of controlling the bubble disappearing position to the outside of the heating element 1 is small.

Furthermore, the inventors of the present application confirmed, in the structure of the second exemplary embodiment, the degree in which the cavitation is formed in the flow path 7 and whether there is damage to the heating element 1 during the ejection durability test when the ink is ejected in the comparative example 7 having the square flow path resistor 9 measuring 3 μm on each side. In the comparative example 7, the distance from the end of the heating element 1 to the center of the flow path resistor 9 is 4.35 μm, and the shortest distance between the flow path resistor 9 and the heating element 1 is 2.85 μm, which are similar to those of the second exemplary embodiment. In the above case, since the length of the liquid contact surface of the flow path resistor 9 is half the length of that of the second exemplary embodiment, as is the case of the comparative example 6, the length of the bubble 120 adhering to the straight portion of the flow path resistor 9 tends to become short. As a result, similar to the comparative example 6, the ultimate position in which the bubble disappears is a position above the heating element 1, and is a position where the cavitation is formed. In other words, it can be understood that even for those in which the position of the flow path resistor 9 is near, a certain length in the liquid contact surface of the flow path resistor is needed. Furthermore, owing to further examination performed by the inventors, while the length of the heating element 1 extending in the long side direction becomes larger the higher the aspect ratio of the heating element 1 becomes, it has been understood that the longer the length of the heating element 1, the larger the distance between the flow path resistor 9 and the center of the heating element 1 becomes. Accordingly, as the aspect ratio of the heating element 1 becomes higher, the effect of controlling the bubble disappearing position to the outside of the heating element 1 becomes smaller. Accordingly, in order to make the bubble disappear at a position above the heating element 1 and prevent the cavitation from being formed, more length is required in the flow path resistor 9 when the length in the long length direction of the heating element 1 is long. As a result of the examination, the inventors understand that L/6 μm or more is needed.

Furthermore, from the examination results described above, it has been known that the preferable range of the displacement amount d in the print head of the present exemplary embodiment is, when using the length L (FIG. 4) extending in the ink supply direction of the heating element, $d \geq L/3.5$. When, with a heating element similar to the one in the second exemplary embodiment without the flow path resistor 9, the limit of the positional displacement amount d in which the area where the degree in which the cavitation is formed is x was examined, the positional displacement amount d was about 10 μm (=the length of the long side of the heating element was 34.4/3.5). In other words, the center of the ejection port 2 and the center of the heating element 1 is spaced apart by, preferably, L/3.5 or more.

With the above configuration, the effect of the cavitation on the heating element can be suppressed in a liquid ejection head that does not perform atmospheric communication.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-235900 filed Dec. 2, 2015, which is hereby incorporated by reference herein in its entirety.

What is claimed is:

1. A liquid ejection head comprising:

a bubble forming chamber capable of retaining a liquid therein;

a heating element disposed in a surface oriented towards the bubble forming chamber, the heating element capable of heating the liquid retained inside the bubble forming chamber;

an ejection port that ejects the liquid that the bubble forming chamber has retained and that has been heated;

an ejecting portion that communicates the liquid between the ejection port and the bubble forming chamber;

a liquid supply port that supplies the liquid to the bubble forming chamber; and a flow path resistor that serves as a resistance of a flow of the liquid in the bubble forming chamber, wherein upon heating performed by the heating element, a bubble is formed in the liquid retained in the bubble forming chamber, the liquid is ejected, and the bubble disappears without any atmospheric communication, wherein when a length L is a length of the heating element in a direction in which the liquid is supplied, when viewing in a direction in which the liquid is ejected, a position of a center of gravity of the ejection port is spaced apart from a position of a center of gravity of the heating element by L/3.5 or more in the direction in which the liquid is ejected, and wherein when a length of the ejecting portion in the direction in which the liquid is ejected is l and a length of the bubble forming chamber in the direction in which the liquid is ejected is h, l/h is 2 or smaller.

2. The liquid ejection head according to claim 1, wherein a distance between a liquid contact surface in the flow path resistor that is on a near side with respect to the heating element and a side of the heating element that is near the liquid supply port is 3 μm or smaller.

3. The liquid ejection head according to claim 1, wherein a length of a liquid contact surface in the flow path resistor is L/6 μm or more.

4. The liquid ejection head according to claim 1, wherein a recessed portion is formed in the flow path resistor on a surface on a back side with respect to a surface on a liquid supply port side.

5. A liquid ejection apparatus comprising:

a liquid head, the liquid head including a bubble forming chamber capable of retaining a liquid therein, a heating element disposed in a surface oriented towards the bubble forming chamber, the heating element capable of heating the liquid retained inside the bubble forming chamber, an ejection port that ejects the liquid that the bubble forming chamber has retained and that has been heated, an ejecting portion that communicates the liquid between the ejection port and the bubble forming chamber, a liquid supply port that supplies the liquid to the bubble forming chamber, and a flow path resistor that serves as a resistance of a flow of the liquid in the bubble forming chamber, wherein, upon heating performed by the heating element, in the liquid head, a bubble is formed in the liquid retained in the bubble forming chamber, the liquid is ejected, and the bubble disappears without any atmospheric communication, wherein the liquid is ejected from the liquid ejection head, wherein when a length L is a length of the heating element in a direction in which the liquid is supplied, when viewing in a direction in which the liquid is ejected, a position of a center of gravity of the ejection port is spaced apart from a position of a center of gravity of the heating element by L/3.5 or more in the direction in which the liquid is ejected, and wherein when a length of the ejecting portion in the direction in which the liquid is ejected is l and a length of the bubble forming chamber in the direction in which the liquid is ejected is h, l/h is 2 or smaller.

* * * * *